US009640017B2

(12) United States Patent
Low et al.

(10) Patent No.: US 9,640,017 B2
(45) Date of Patent: May 2, 2017

(54) GAMING SYSTEM AND METHOD EMPLOYING RANKINGS OF OUTCOMES FROM MULTIPLE GAMING MACHINES TO DETERMINE AWARDS

(75) Inventors: Michael N. Low, Sparks, NV (US); Michael M. Oberberger, Reno, NV (US)

(73) Assignee: IGT, Las Vegas, NV (US)

( * ) Notice: Subject to any disclaimer, the term of this patent is extended or adjusted under 35 U.S.C. 154(b) by 2685 days.

(21) Appl. No.: 11/215,980

(22) Filed: Aug. 31, 2005

(65) Prior Publication Data

US 2007/0060247 A1 Mar. 15, 2007

(51) Int. Cl.
*A63F 9/24* (2006.01)
*G07F 17/32* (2006.01)

(52) U.S. Cl.
CPC ..... *G07F 17/32* (2013.01)

(58) Field of Classification Search
CPC .. G07F 17/32; G07F 17/3244; G07F 17/3267; G07F 17/34
USPC ..... 463/16, 20, 25; 273/138.1, 139
See application file for complete search history.

(56) References Cited

U.S. PATENT DOCUMENTS 3,645,531 A 2/1972 Wright
3,998,309 A 12/1976 Mandas et al.
4,072,930 A 2/1978 Lucero et al.
4,238,127 A 12/1980 Lucero et al.
4,277,064 A 7/1981 Newman
4,283,709 A 8/1981 Lucero et al.
4,335,809 A 6/1982 Wain
4,339,798 A 7/1982 Hedges et al.
(Continued)

FOREIGN PATENT DOCUMENTS

AU 524709 9/1982
AU 555905 10/1986
(Continued)

OTHER PUBLICATIONS

Aristocrat Brochure, written by Aristocrat Gaming, published in 2004.

(Continued)

*Primary Examiner* — David L Lewis
*Assistant Examiner* — Chase Leichliter
(74) *Attorney, Agent, or Firm* — Neal, Gerber & Eisenberg LLP

(57) ABSTRACT

A gaming system is provided in which multiple gaming machines are linked. Each of the machines plays its game and generates at least one outcome. The top or best outcome of each machine is submitted, e.g., to a comparator or server computer for ranking. An award is provided for a certain percentage such as one-half of the highest ranked outcomes. The award is made available to the gaming machine, but a player must be wagering on the associated outcome producing event (such as the payline) to receive the award. For example, if a player plays only payline one of a multi-line slot machine and payline five of that machine generates the highest ranked result of all linked gaming machines, the award is made available to the gaming machine, but the player does not receive the award. In an embodiment, each linked gaming machine participates in play (all paylines) regardless of whether a player is playing that gaming machine.

45 Claims, 11 Drawing Sheets

(56) References Cited

U.S. PATENT DOCUMENTS 4,409,656 A 10/1983 Andersen et al.
4,448,419 A 5/1984 Telnaes
4,494,197 A 1/1985 Troy et al.
4,573,681 A 3/1986 Okada
4,582,324 A 4/1986 Koza et al.
4,614,342 A 9/1986 Takashima
4,624,459 A 11/1986 Kaufman
4,652,998 A 3/1987 Koza et al.
4,669,731 A 6/1987 Clarke
4,678,191 A 7/1987 Mills et al.
4,679,143 A 7/1987 Hagiwara
4,695,053 A 9/1987 Vazquez, Jr. et al.
4,721,307 A 1/1988 Okada
4,743,024 A 5/1988 Helm et al.
4,760,527 A 7/1988 Sidley
4,775,155 A 10/1988 Lees
4,805,907 A 2/1989 Hagiwara
4,817,951 A 4/1989 Crouch et al.
4,837,728 A 6/1989 Barrie et al.
4,842,278 A 6/1989 Markowicz
4,856,787 A 8/1989 Itkis
4,871,171 A 10/1989 Rivero
4,926,327 A 5/1990 Sidley
4,964,638 A 10/1990 Ishida
4,976,438 A 12/1990 Tashiro et al.
4,991,848 A 2/1991 Greenwood et al.
5,038,022 A 8/1991 Lucero
5,046,736 A 9/1991 Bridgeman et al.
5,048,833 A 9/1991 Lamle
5,074,559 A 12/1991 Okada
5,083,271 A 1/1992 Thacher et al.
5,083,800 A 1/1992 Lockton
5,116,055 A 5/1992 Tracy
5,120,060 A 6/1992 Parker et al.
5,123,649 A 6/1992 Tiberio
5,127,651 A 7/1992 Okada
5,152,529 A 10/1992 Okada
5,158,293 A 10/1992 Mullins
5,167,413 A 12/1992 Fulton
5,186,460 A 2/1993 Fongeallaz et al.
5,188,363 A 2/1993 Marnell, II et al.
5,209,479 A 5/1993 Nagao
5,217,224 A 6/1993 Sincock
5,221,083 A 6/1993 Dote
5,242,163 A 9/1993 Fulton
5,249,800 A 10/1993 Hilgendorf et al.
5,259,616 A 11/1993 Bergmann
5,265,874 A 11/1993 Dickinson et al.
5,275,400 A 1/1994 Weingardt
5,276,312 A 1/1994 McCarthy
5,277,424 A 1/1994 Wilms
5,280,909 A 1/1994 Tracy
344,296 A 2/1994 McKay et al.
5,286,023 A 2/1994 Wood
5,288,081 A 2/1994 Breeding
5,290,033 A 3/1994 Bittner et al.
5,292,127 A 3/1994 Kelly et al.
5,321,241 A 6/1994 Craine
5,324,035 A 6/1994 Morris et al.
5,326,104 A 7/1994 Pease et al.
5,342,047 A 8/1994 Heidel et al.
5,342,049 A 8/1994 Wichinsky et al.
5,344,144 A 9/1994 Canon
5,351,970 A 10/1994 Fioretti
5,377,993 A 1/1995 Josephs
5,393,057 A 2/1995 Marnell, II
5,397,125 A 3/1995 Adams
5,398,932 A 3/1995 Eberhardt et al.
5,401,024 A 3/1995 Simunek
5,411,270 A 5/1995 Naka et al.
5,417,430 A 5/1995 Breeding
5,423,539 A 6/1995 Nagao
5,429,361 A 7/1995 Raven et al.
5,431,492 A 7/1995 Rothschild et al.
5,456,465 A 10/1995 Durham
5,470,079 A 11/1995 LeStrange et al.
5,472,194 A 12/1995 Breeding et al.
5,472,197 A 12/1995 Gwiasda et al.
5,489,101 A 2/1996 Moody
5,511,781 A 4/1996 Wood
5,524,888 A 6/1996 Heidel
5,536,016 A 7/1996 Thompson
5,544,892 A 8/1996 Breeding
5,547,192 A 8/1996 Ishibashi
5,560,603 A 10/1996 Seelig et al.
5,564,700 A 10/1996 Celona
5,564,701 A 10/1996 Dettor
5,566,337 A 10/1996 Szymanski
5,570,885 A 11/1996 Ornstein
5,580,053 A 12/1996 Crouch
5,580,309 A 12/1996 Piechowiak et al.
5,584,763 A 12/1996 Kelly et al.
5,601,487 A 2/1997 Oshima
5,605,506 A 2/1997 Hoorn et al.
5,611,535 A 3/1997 Tiberio
5,611,730 A 3/1997 Weiss
5,622,366 A 4/1997 Inoue
5,626,341 A 5/1997 Jones
5,634,639 A 6/1997 Tokito et al.
5,639,089 A 6/1997 Matsumoto et al.
5,645,486 A 7/1997 Nagao et al.
5,655,961 A 8/1997 Acres et al.
383,171 A 9/1997 Hanscom
5,664,998 A 9/1997 Seelig et al.
5,674,127 A 10/1997 Horstmann et al.
5,674,128 A 10/1997 Holch et al.
5,695,400 A 12/1997 Fennell, Jr. et al.
5,702,304 A 12/1997 Acres et al.
5,707,285 A 1/1998 Place et al.
5,722,891 A 3/1998 Inoue
5,732,948 A 3/1998 Yoseloff
5,741,183 A 4/1998 Acres et al.
5,743,800 A 4/1998 Huard et al.
5,752,882 A 5/1998 Acres et al.
5,755,619 A 5/1998 Matsumoto et al.
5,755,621 A 5/1998 Marks et al.
5,758,875 A 6/1998 Giacalone, Jr.
5,761,647 A 6/1998 Boushy
5,762,552 A 6/1998 Vuong
5,766,076 A 6/1998 Pease et al.
5,769,716 A 6/1998 Saffari et al.
5,772,509 A 6/1998 Weiss
5,772,511 A 6/1998 Smeltzer
RE35,864 E 7/1998 Weingardt
5,779,242 A 7/1998 Kaufmann
5,779,544 A 7/1998 Seelig et al.
5,779,545 A 7/1998 Berg et al.
5,779,549 A 7/1998 Walker et al.
5,788,573 A 8/1998 Baerlocher et al.
5,800,269 A 9/1998 Holch et al.
5,806,045 A 9/1998 Biorge et al.
5,806,855 A 9/1998 Cherry
5,807,172 A 9/1998 Piechowiak
5,816,918 A 10/1998 Kelly et al.
5,816,920 A 10/1998 Hanai
5,820,459 A 10/1998 Acres et al.
5,820,460 A 10/1998 Fulton
5,823,874 A 10/1998 Adams
5,823,879 A 10/1998 Goldberg et al.
5,830,063 A 11/1998 Byrne
5,833,536 A 11/1998 Davids et al.
5,833,537 A 11/1998 Barrie
5,833,538 A 11/1998 Weiss
5,833,540 A 11/1998 Miodunski et al.
5,836,817 A 11/1998 Acres et al.
5,846,132 A 12/1998 Junkin
5,848,932 A 12/1998 Adams
5,851,011 A 12/1998 Lott
5,851,148 A 12/1998 Brune et al.
5,851,149 A 12/1998 Xidos et al.
404,436 A 1/1999 McGahn et al.
5,855,514 A 1/1999 Kamille
5,855,515 A 1/1999 Pease et al.
5,876,284 A 3/1999 Acres et al.

(56) References Cited

U.S. PATENT DOCUMENTS 5,879,235 A 3/1999 Kaneko et al.
5,882,261 A 3/1999 Adams
5,885,158 A 3/1999 Torango et al.
5,902,184 A 5/1999 Bennett
5,902,983 A 5/1999 Crevelt et al.
5,910,048 A 6/1999 Feinberg
5,911,418 A 6/1999 Adams
5,917,725 A 6/1999 Thacher et al.
5,919,088 A 7/1999 Weiss
5,924,927 A 7/1999 Matsuura et al.
5,935,000 A 8/1999 Sanchez, III et al.
5,941,772 A 8/1999 Paige
5,941,773 A 8/1999 Harlick
5,944,606 A 8/1999 Gerow
5,947,820 A 9/1999 Morro et al.
5,947,822 A 9/1999 Weiss
5,951,011 A 9/1999 Potter et al.
5,951,397 A 9/1999 Dickinson
5,967,820 A 10/1999 Siegal et al.
5,976,015 A 11/1999 Seelig et al.
5,976,019 A 11/1999 Ikeda et al.
5,980,384 A 11/1999 Barrie
5,984,782 A 11/1999 Inoue
5,989,121 A 11/1999 Sakamoto
5,993,316 A 11/1999 Coyle et al.
5,997,400 A 12/1999 Seelig et al.
6,001,016 A 12/1999 Walker et al.
6,004,207 A 12/1999 Wilson, Jr. et al.
6,007,427 A 12/1999 Wiener
6,012,982 A 1/2000 Piechowiak et al.
6,012,983 A 1/2000 Walker et al.
6,015,344 A 1/2000 Kelly et al.
421,068 A 2/2000 Yamaguchi
6,019,369 A 2/2000 Nakagawa et al.
6,019,374 A 2/2000 Breeding
6,023,729 A 2/2000 Samuel et al.
6,027,115 A 2/2000 Griswold et al.
6,033,307 A 3/2000 Vancura
6,039,648 A 3/2000 Guinn et al.
6,039,649 A 3/2000 Schulze
6,043,615 A 3/2000 Forbes
6,048,269 A 4/2000 Burns et al.
6,050,895 A 4/2000 Luciano et al.
6,056,642 A 5/2000 Bennett
6,059,289 A 5/2000 Vancura
6,059,658 A 5/2000 Mangano et al.
6,068,553 A 5/2000 Parker
6,077,162 A 6/2000 Weiss
6,082,734 A 7/2000 Uehara et al.
6,082,887 A 7/2000 Feuer et al.
6,089,975 A 7/2000 Dunn
6,089,976 A 7/2000 Schneider et al.
6,089,977 A 7/2000 Bennett
6,089,978 A 7/2000 Adams
6,089,980 A 7/2000 Gauselmann
6,099,408 A 8/2000 Schneier et al.
6,102,400 A 8/2000 Scott et al.
6,105,962 A 8/2000 Malavazos et al.
6,110,041 A 8/2000 Walker et al.
6,110,043 A 8/2000 Olsen
6,113,098 A 9/2000 Adams
6,117,009 A 9/2000 Yoseloff
6,117,013 A 9/2000 Eiba
6,120,376 A * 9/2000 Cherry ..... 463/16
6,120,378 A 9/2000 Moody et al.
6,128,550 A 10/2000 Heidel et al.
6,135,884 A 10/2000 Hedrick et al.
6,135,885 A 10/2000 Lermusiaux
6,142,872 A 11/2000 Walker et al.
6,142,873 A 11/2000 Weiss et al.
6,149,521 A 11/2000 Sanduski
6,152,823 A 11/2000 Lacoste et al.
6,155,925 A 12/2000 Giobbi et al.
6,159,095 A 12/2000 Frohm et al.
6,159,097 A 12/2000 Gura
6,159,098 A 12/2000 Slomiany et al.
6,162,121 A 12/2000 Morro et al.
6,162,122 A 12/2000 Acres et al.
6,165,071 A 12/2000 Weiss
6,165,072 A 12/2000 Davis et al.
6,168,520 B1 1/2001 Baerlocher et al.
6,168,521 B1 1/2001 Luciano et al.
6,183,366 B1 2/2001 Goldberg et al.
6,186,893 B1 2/2001 Walker et al.
6,186,894 B1 2/2001 Mayeroff
6,190,255 B1 2/2001 Thomas et al.
6,193,606 B1 2/2001 Walker et al.
6,193,610 B1 2/2001 Junkin
439,282 A1 3/2001 Yamaguchi
6,201,532 B1 3/2001 Tode et al.
6,203,010 B1 3/2001 Jorasch et al.
6,203,430 B1 3/2001 Walker et al.
6,206,374 B1 3/2001 Jones
6,206,782 B1 3/2001 Walker et al.
6,210,275 B1 4/2001 Olsen
6,210,277 B1 4/2001 Stefan
6,217,448 B1 4/2001 Olsen
6,224,482 B1 5/2001 Bennett
6,224,483 B1 5/2001 Mayeroff
6,224,484 B1 5/2001 Okuda et al.
6,224,486 B1 5/2001 Walker et al.
6,231,442 B1 5/2001 Mayeroff
6,231,445 B1 5/2001 Acres
6,238,287 B1 5/2001 Komori et al.
6,238,288 B1 5/2001 Walker et al.
6,241,608 B1 6/2001 Torango
6,244,958 B1 6/2001 Acres
6,254,483 B1 7/2001 Acres
6,257,981 B1 7/2001 Acres et al.
6,264,557 B1 7/2001 Schneier et al.
6,264,560 B1 7/2001 Goldberg et al.
6,270,409 B1 8/2001 Shuster
6,280,325 B1 8/2001 Fisk
6,287,202 B1 9/2001 Pascal et al.
6,293,866 B1 9/2001 Walker et al.
RE37,414 E 10/2001 Harlick
6,302,790 B1 10/2001 Brossard
6,302,793 B1 10/2001 Fertitta, III et al.
6,309,298 B1 10/2001 Gerow
6,309,299 B1 10/2001 Weiss
6,309,300 B1 10/2001 Glavich
6,309,307 B1 10/2001 Krause et al.
D451,153 S 11/2001 Hedrick et al.
6,311,976 B1 11/2001 Yoseloff et al.
6,312,330 B1 11/2001 Jones et al.
6,312,333 B1 11/2001 Acres
6,315,662 B1 11/2001 Jorasch et al.
6,319,122 B1 11/2001 Packes, Jr. et al.
6,319,125 B1 11/2001 Acres
D451,558 S 12/2001 Sano
6,328,649 B1 12/2001 Randall et al.
6,334,814 B1 1/2002 Adams
6,336,857 B1 1/2002 McBride
6,336,863 B1 1/2002 Baerlocher et al.
6,340,158 B2 1/2002 Pierce et al.
6,346,043 B1 2/2002 Colin et al.
6,347,996 B1 2/2002 Gilmore et al.
6,358,147 B1 3/2002 Jaffe et al.
6,358,149 B1 3/2002 Schneider et al.
6,361,441 B1 3/2002 Walker et al.
6,364,314 B1 4/2002 Canterbury
6,364,765 B1 4/2002 Walker et al.
6,364,766 B1 4/2002 Anderson et al.
6,364,767 B1 4/2002 Brossard et al.
6,364,768 B1 4/2002 Acres et al.
6,364,769 B1 4/2002 Weiss et al.
6,371,852 B1 4/2002 Acres
6,375,567 B1 4/2002 Acres
6,375,568 B1 4/2002 Roffman et al.
6,375,569 B1 4/2002 Acres
6,386,974 B1 5/2002 Adams
6,398,218 B1 6/2002 Vancura
6,406,369 B1 6/2002 Baerlocher et al.
6,409,595 B1 6/2002 Uihlein et al.

(56) References Cited

U.S. PATENT DOCUMENTS 6,416,408 B2 7/2002 Tracy et al.
6,416,409 B1 7/2002 Jordan
6,419,579 B1 7/2002 Bennett
6,419,583 B1 7/2002 Crumby et al.
6,425,828 B2 7/2002 Walker et al.
6,428,412 B1 8/2002 Anderson et al.
6,431,983 B2 8/2002 Acres
6,435,511 B1 8/2002 Vancura et al.
6,435,968 B1 8/2002 Torango
D462,397 S 9/2002 Baker et al.
6,454,651 B1 9/2002 Yoseloff
RE37,885 E 10/2002 Acres et al.
6,461,241 B1 10/2002 Webb et al.
6,464,582 B1 10/2002 Baerlocher et al.
6,464,586 B1 10/2002 Kamata et al.
6,471,208 B2 10/2002 Yoseloff et al.
6,475,090 B2 11/2002 Roelofs
6,481,713 B2 11/2002 Perrie et al.
6,491,584 B2 12/2002 Graham et al.
6,503,145 B1 1/2003 Webb
6,506,117 B2 1/2003 DeMar et al.
6,508,709 B1 1/2003 Karmarkar
6,533,664 B1 3/2003 Crumby
6,537,150 B1 3/2003 Luciano et al.
D475,091 S 5/2003 Tsuda
6,561,904 B2 5/2003 Locke et al.
6,565,434 B1 5/2003 Acres
6,569,015 B1 5/2003 Baerlocher et al.
6,572,471 B1 6/2003 Bennett
6,572,473 B1 6/2003 Baerlocher
6,575,832 B1 6/2003 Manfredi et al.
6,589,115 B2 7/2003 Walker et al.
6,592,460 B2 7/2003 Torango
6,595,853 B1 7/2003 Osawa
6,599,190 B2 7/2003 Osawa
6,599,193 B2 7/2003 Baerlocher et al.
6,607,195 B2 8/2003 Vancura
6,607,441 B1 8/2003 Acres
6,609,973 B1 8/2003 Weiss
6,620,046 B2 9/2003 Rowe
6,626,758 B1 9/2003 Parham et al.
6,629,887 B1 10/2003 Todaiji et al.
6,634,944 B2 10/2003 Osawa
6,645,077 B2 11/2003 Rowe
6,648,753 B1 11/2003 Tracy et al.
6,648,759 B2 11/2003 Vancura
6,656,047 B1 12/2003 Tarantino et al.
6,656,048 B2 12/2003 Olsen
6,656,052 B2 12/2003 Abramopoulos et al.
6,663,488 B1 12/2003 Adams
6,675,152 B1 1/2004 Prasad et al.
D486,869 S 2/2004 Webb et al.
6,692,354 B2 2/2004 Tracy et al.
6,692,355 B2 2/2004 Baerlocher et al.
D487,582 S 3/2004 McGahn et al.
6,705,944 B2 3/2004 Luciano
6,712,693 B1 3/2004 Hettinger
6,712,695 B2 3/2004 Mothwurf et al.
6,712,697 B2 3/2004 Acres
6,712,702 B2 3/2004 Goldberg et al.
6,715,756 B2 4/2004 Inoue
6,719,630 B1 4/2004 Seelig et al.
6,722,976 B2 4/2004 Adams
6,749,510 B2 6/2004 Giobbi
6,776,714 B2 8/2004 Ungaro et al.
6,776,715 B2 8/2004 Price
6,800,030 B2 10/2004 Acres
6,805,352 B2 10/2004 Hunter
6,817,948 B2 11/2004 Pascal et al.
6,832,958 B2 12/2004 Acres et al.
6,837,788 B2 1/2005 Cannon
6,884,167 B2 4/2005 Walker et al.
6,887,154 B1 5/2005 Luciano, Jr. et al.
6,899,625 B2 5/2005 Luciano, Jr. et al.
6,899,628 B2 5/2005 Leen et al.
6,910,964 B2 6/2005 Acres
6,918,834 B2 7/2005 Vancura
6,939,234 B2 9/2005 Beatty
RE38,812 E 10/2005 Acres et al.
6,966,834 B1 11/2005 Johnson
2001/0003709 A1 6/2001 Adams
2001/0004606 A1 6/2001 Tracy et al.
2001/0018361 A1 8/2001 Acres
2001/0049303 A1 12/2001 Found
2001/0055990 A1 12/2001 Acres
2002/0028707 A1 3/2002 Pascal et al.
2002/0039923 A1 4/2002 Cannon et al.
2002/0052234 A1 5/2002 Adams
2002/0055381 A1 5/2002 Tarantino
2002/0065123 A1* 5/2002 Packes et al. ..... 463/16
2002/0103029 A1 8/2002 Finlayson et al.
2002/0138594 A1 9/2002 Rowe
2002/0142826 A1 10/2002 Adams
2002/0142830 A1 10/2002 Adams
2002/0151342 A1 10/2002 Tracy et al.
2002/0152120 A1 10/2002 Howington
2002/0160825 A1* 10/2002 Nicastro et al. ..... 463/16
2002/0165023 A1 11/2002 Brosnan et al.
2002/0177483 A1 11/2002 Cannon
2002/0198038 A1 12/2002 Adams
2003/0011127 A1 1/2003 Vancura et al.
2003/0013520 A1 1/2003 Adams
2003/0027625 A1 2/2003 Rowe
2003/0027630 A1 2/2003 Kelly et al.
2003/0040355 A1 2/2003 Baerlocher
2003/0045350 A1 3/2003 Baerlocher et al.
2003/0045360 A1 3/2003 Hora
2003/0060266 A1 3/2003 Baerlocher
2003/0060277 A1 3/2003 Webb et al.
2003/0060279 A1 3/2003 Torango
2003/0064796 A1 4/2003 Glavich et al.
2003/0087689 A1 5/2003 Adams
2003/0092484 A1 5/2003 Schneider et al.
2003/0100361 A1 5/2003 Sharpless et al.
2003/0114216 A1 6/2003 Adams
2003/0130041 A1 7/2003 Pascal et al.
2003/0144965 A1 7/2003 Prasad et al.
2003/0157979 A1 8/2003 Cannon et al.
2003/0181234 A1 9/2003 Falciglia, Sr.
2003/0190957 A1 10/2003 Tanskanen
2003/0199316 A1 10/2003 Miyamoto et al.
2003/0222402 A1 12/2003 Olive
2003/0228904 A1 12/2003 Acres et al.
2004/0002372 A1 1/2004 Rodgers et al.
2004/0009807 A1 1/2004 Miller et al.
2004/0009811 A1 1/2004 Torango
2004/0033831 A1 2/2004 Tarantino
2004/0038728 A1 2/2004 Adams
2004/0038734 A1 2/2004 Adams
2004/0048645 A1 3/2004 Webb et al.
2004/0051240 A1 3/2004 Adams
2004/0053660 A1 3/2004 Webb et al.
2004/0053665 A1 3/2004 Baerlocher
2004/0072615 A1 4/2004 Maya et al.
2004/0082378 A1 4/2004 Peterson et al.
2004/0087368 A1 5/2004 Gavselmann
2004/0102237 A1 5/2004 Baerlocher
2004/0121838 A1 6/2004 Hughs-Baird et al.
2004/0147306 A1 7/2004 Randall et al.
2004/0162128 A1 8/2004 Baerlocher et al.
2004/0242297 A1 12/2004 Walker
2004/0242306 A1* 12/2004 Tarantino ..... 463/16
2004/0259627 A1* 12/2004 Walker et al. ..... 463/20
2005/0003882 A1* 1/2005 Nara ..... 463/16
2005/0032573 A1 2/2005 Acres et al.
2005/0059474 A1 3/2005 O'Halloran
2005/0070356 A1 3/2005 Mothwurf
2005/0079911 A1 4/2005 Nakatsu
2005/0101384 A1 5/2005 Parham
2005/0110215 A1* 5/2005 Jackson ..... 273/292
2005/0119047 A1 6/2005 Olive
2005/0137014 A1 6/2005 Vetelainen
2005/0143168 A1 6/2005 Torango
2005/0153780 A1 7/2005 Gauselmann

(56) References Cited

U.S. PATENT DOCUMENTS

| | | | | |
|---|---|---|---|---|
| 2005/0159211 | A1 | 7/2005 | Englman | |
| 2005/0176488 | A1 | 8/2005 | Olive | |
| 2005/0192083 | A1 | 9/2005 | Iwamoto | |
| 2005/0209004 | A1 | 9/2005 | Torango | |
| 2005/0239542 | A1 | 10/2005 | Olsen | |
| 2005/0267610 | A1 | 12/2005 | Shinoda | |
| 2006/0003829 | A1 | 1/2006 | Thomas | |
| 2006/0100019 | A1* | 5/2006 | Hornik et al. | 463/42 |

FOREIGN PATENT DOCUMENTS

| | | | |
|---|---|---|---|
| AU | 567001 | | 11/1987 |
| AU | 585160 | | 6/1989 |
| AU | 589158 | | 10/1989 |
| AU | 593059 | | 2/1990 |
| AU | 630112 | | 3/1990 |
| AU | 628330 | | 9/1992 |
| AU | 633469 | | 1/1993 |
| AU | 649009 | | 5/1994 |
| AU | 655801 | | 1/1995 |
| AU | 1996 70247 | | 4/1997 |
| AU | 680920 | | 8/1997 |
| AU | 1996 50327 | A | 10/1997 |
| AU | 1998 63553 | A | 10/1998 |
| AU | 1998 84162 | A1 | 3/1999 |
| AU | 707687 | | 7/1999 |
| AU | 1999 17318 | A1 | 9/1999 |
| AU | 709724 | | 9/1999 |
| AU | 711501 | | 10/1999 |
| AU | 716299 | | 2/2000 |
| AU | 721968 | | 7/2000 |
| AU | 722107 | | 7/2000 |
| AU | 728788 | | 1/2001 |
| AU | 2001 1000032 | B4 | 11/2001 |
| AU | 2001 1000033 | B4 | 11/2001 |
| AU | 748263 | | 5/2002 |
| AU | 749222 | | 6/2002 |
| AU | 754689 | | 11/2002 |
| AU | 758306 | | 3/2003 |
| AU | 1999 43453 | C | 4/2003 |
| DE | 3 415 114 | | 11/1985 |
| DE | 3 917 683 | | 12/1990 |
| DE | 4 200 254 | | 8/1993 |
| EP | 0 342 797 | | 11/1989 |
| EP | 0 609 970 | A2 | 10/1994 |
| EP | 0 798 676 | A1 | 10/1997 |
| EP | 0 874 337 | A1 | 10/1998 |
| EP | 0 926 645 | A2 | 6/1999 |
| EP | 0 944 030 | A2 | 9/1999 |
| EP | 0 945 837 | A2 | 9/1999 |
| EP | 0 981 119 | A2 | 2/2000 |
| EP | 0 984 407 | A2 | 8/2000 |
| EP | 1 467 329 | A2 | 10/2004 |
| EP | 1 494 181 | A2 | 1/2005 |
| EP | 1 498 860 | A1 | 1/2005 |
| EP | 1 513 114 | A2 | 3/2005 |
| EP | 1 528 516 | A2 | 5/2005 |
| EP | 1 528 517 | A2 | 5/2005 |
| GB | 2 098 776 | | 11/1982 |
| GB | 2 118 445 | | 11/1983 |
| GB | 2 137 392 | A | 10/1984 |
| GB | 2 139 390 | | 11/1984 |
| GB | 2 147 773 | | 5/1985 |
| GB | 2 148 135 | | 5/1985 |
| GB | 1 151 054 | A | 7/1985 |
| GB | 2 153 572 | A | 8/1985 |
| GB | 2 201 821 | | 9/1988 |
| GB | 2 231 189 | | 11/1990 |
| GB | 2 282 690 | | 4/1995 |
| GB | 2 322 217 | | 8/1998 |
| GB | 2 328 311 | | 2/1999 |
| GB | 2 387 703 | | 10/2003 |
| JP | 7148307 | | 6/1995 |
| WO | WO 94 12256 | | 6/1994 |
| WO | WO 95 22811 | | 8/1995 |
| WO | WO 95 30944 | | 11/1995 |
| WO | WO 97 12338 | | 4/1997 |
| WO | WO 97 27568 | | 7/1997 |
| WO | WO 98 00210 | | 1/1998 |
| WO | WO 98 35309 | | 8/1998 |
| WO | WO 98 47115 | | 10/1998 |
| WO | WO 98 51384 | | 11/1998 |
| WO | WO 99 03078 | | 1/1999 |
| WO | WO 99 10849 | | 3/1999 |
| WO | WO 00 12186 | | 3/2000 |
| WO | WO 00 20082 | | 4/2000 |
| WO | WO 00 32286 | | 6/2000 |
| WO | WO 01 10523 | | 2/2001 |
| WO | WO 01 15055 | | 3/2001 |
| WO | WO 01 15790 | A1 | 3/2001 |
| WO | WO 02 096528 | A2 | 12/2002 |
| WO | PCT/US02/30858 | | 4/2003 |
| WO | WO 2003 075235 | | 9/2003 |
| WO | WO 2004 066061 | A2 | 8/2004 |
| WO | WO 2005 076193 | | 8/2005 |
| WO | WO 2005 081623 | A2 | 9/2005 |
| WO | WO 2005 083599 | A1 | 9/2005 |
| WO | WO 2005 099425 | A2 | 10/2005 |
| WO | WO 2005 099845 | A1 | 10/2005 |
| WO | WO 2005 106702 | | 11/2005 |
| WO | WO 2005 113093 | | 12/2005 |

OTHER PUBLICATIONS

Auction Fever Advertisement, written by Sierre Design Group, available prior to 2004.

Bally Slot Machines Electro-Mechanicals 1964-1980 Book [In Part], Revised 3rd Edition written by Marshall Fey.

Cash Express Game advertisement, published by Aristocrat in 2001.

Cash Express Game advertisement, published by Aristocrat in 2002.

Cath Express Game advertisement, published by Aristocrat, prior to Sep. 30, 2004.

Cash Express How to Play Guide advertisement, published by Aristocrat prior to Sep. 30, 2004.

Catalogue of Champions Advertisement, written by Aristocrat, published in 1990.

Computa Game Equipment Manual written and compiled by Russell Campbell, Sep. 1990.

Computa Game, "The Software Manual", Revision 3 for Computa Game Software Version 2.41 written by Clive Davis et al., published by Computa Game Pty Ltd., Jul. 1991.

Derby Champion advertisement, written by Chang Myung Co., Ltd., published prior to Sep. 30, 2004.

EZ-Pay and Related Brochures published by IGT by Dec. 2000.

Fast Buck Systems Manual, written by International Game Technology, available to Mirage shift supervisors at least as early as May 30, 1990.

Integrated Real Time On-Line Slot System—SDI, written by GRIPS Electronic GmbH, printed from website reported as archived on Feb. 20, 1997 (available at http://web.archive.org/web/19970220165559/www.grips.com/sdi.htm).

Jackpot Carnival Hyperlink Advertisement, written by Aristocrat, published prior to 2002.

Lemons, Cherries and Bell-Fruit-Gum, pp. 1 to 4 and 304 to 314, written by Bueschel, published in Royal Bell Books in Nov. 1995.

Mega Multiplier®, printed from www.wmsgaming.com, on May 22, 2001.

Mikohn Product Catalog, Chapters 1, 2, 6, 7 and 8, written by Mikohn, published in Jan. 1993.

Mikohn Supper Controller Manual, Chapters 1 to 3 and 6 to 7, written by Mikohn, published in 1989.

Millioni$er articles, written by Strictly Slots, published in Sep. 2003 and Mar. 2004.

PEM—Precision Electronic Meter, written by GRIPS Electronic GmbH, printed from website reported as archived on Feb. 20, 1997 (available at http://web.archive.org/web/19970220165753/www.grips.com/pem.htm.

Player Tracking and Related Brochures published by IGT by Aug. 2001.

(56) References Cited

OTHER PUBLICATIONS

Progressive Jackpot System article, printed from casinomagazine.com.managearticle.asp@c_290&a=518, on Jun. 21, 2004.
ProLINK Progressive Controller User/Reference Manual, written by Casino Data Systems, published in Apr. 1997.
Scarne, Scarne's New Complete Guide to Gambling, 1974, Simon & Schuster, 162-167.
Slot Line Progressive Advertisement, written by IGT, published in 1993.
Slot-Line Progressive Advertisement, written by IGT, published in 1994.
Slot Line Progressive Advertisement, written by IGT, published in 1995.
Slot Line Progressive Mega Jackpots Advertisement, written by IGT, published in 1997.
Slot Line Temperature Rising Game Description, written by IGT, published in 1998.
Slot Machines A Pictorial History of the First 100 Years (pp. 216, 242 to 243), 5th edition, written by Marshall Fey, published in 1983-1997.
Surprize Gaming Machine Advertisement, written by Aristocrat Leisure Industries, Australia, published prior to 2004.
Surprize Software Specification for MV2030—var 01, written by Aristocrat Leisure Industries, Australia, published prior to 2004.
Vision Series Good Times Advertisement, written by IGT, published in 1999.
Wide Area Progressive Link System, written by GRIPS Electronic GmbH, printed from website reported as archived on Feb. 20, 1997 (available at http://web.archive.org/web/19970220165457/www.grips.com/wap.htm).
Zorro Advertisement, written by Aristocrat, published in 2004.

* cited by examiner

FIG. 8

| Poker | Slot Symbol | |
|---|---|---|
| Hand | Combinations | Probability |
| Royal Flush | 7 7 7 7 7 | 0.00000154 |
| Straight Flush | ▭ ▭ ▭ ▭ ▭ | 0.00001385 |
| Four of a Kind | ♣ ♣ ♣ ♣ ♣ | 0.00024010 |
| Full House | 7 7 7 7 | 0.00144058 |
| Flush | ▭ ▭ ▭ ▭ | 0.00196540 |
| Straight | ♣ ♣ ♣ ♣ | 0.00392465 |
| Three of a Kind | 7 7 7 | 0.02112845 |
| Two Pair | ▭ ▭ ▭ | 0.04753902 |
| Pair | ♣ ♣ ♣ | 0.42256903 |
| Nothing | All Others | 0.501177394 |

GAMING SYSTEM AND METHOD EMPLOYING RANKINGS OF OUTCOMES FROM MULTIPLE GAMING MACHINES TO DETERMINE AWARDS

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming devices provide enjoyment and excitement to players, in part, because they may ultimately lead to monetary awards for the players. Gaming devices also provide enjoyment and excitement to players because they are fun to play. Gaming devices in most jurisdictions are typically games of luck, not skill. They are configured on average to pay back a certain percentage of the amount of money wagered. The average payback percentage in most wagering games is set high enough that any player who plays a few hands or spins of the reels wins. That is, in most wagering games it is not too difficult to experience some level of success.

Most existing slot machines are generally a single player experience. That is, the player plays the wagering game and achieves an outcome. The determination on whether the player wins is determined based on comparing the outcome against the machine's paytable. While this use of paytable has proven to be very successful, the gaming industry is always looking for different attractions and ways to enhance the player's gaming experience.

SUMMARY

The gaming system and method disclosed herein can be employed in any suitable wagering game such as slot, poker, blackjack, keno, roulette or other games. The system and method is generally applicable to any type of game that generates one or more outcomes that can be ranked. In the system, multiple individual gaming machines are linked. Each of the gaming machines plays its game and generates at least one outcome. If the gaming machines each generate only one outcome, those outcomes are submitted for ranking to a comparator or server computer. In one embodiment, if the gaming machines each generate multiple outcomes for a play of a game (such as simultaneously along multiple paylines of a slot machine), a highest ranked outcome from each gaming machine is submitted for ranking. In alternative embodiments, a plurality or all of the multiple outcomes from each machine are submitted for ranking. The system and method thus includes at least one ranking and can include a second set of rankings for determining which outcome(s) from each gaming machine are the top ranking (s) or can include a second set of rankings made by each individual gaming machines to determine which outcomes are sent for the overall ranking.

After the multiple gaming machine ranking, the system makes one or more awards available to a certain percentage, for example one-half of the top ranked gaming machines (i.e., the gaming machines with the top ranked outcomes). The gaming system provides those awards to the players of the gaming machines which obtained those top-ranked outcomes. In one embodiment, for example, a player must be playing the associated top-ranked machine to receive the award determined for the top ranked gaming machine. If the top-ranked machine generates multiple outcomes, the player of that gaming machine needs to have wagered upon the wagerable option, payline or hand leading to the top-ranked outcome to receive the award.

In one embodiment, the system includes the generation of each of the outcomes for each of the linked gaming machines whether or not that machine is being played. If one of the outcomes is the top-ranked outcome which has been wagered upon by a player of that gaming machine, the system provides the top ranked award to that player. If that outcome has not been wagered upon by the player (e.g., the player did not wager on the payline on which that outcome occurred), the system does not issue that top ranked award. The house can keep those awards or designate a portion or all of those awards to build a progressive pool or other bonus pool.

Using one primary embodiment of the present invention as an example, the system includes a plurality of linked slot machines in which multiple players can each play the slot game at the same time at a casino. Many slot machines have multiple paylines, which provide the player with an opportunity to play one payline (generating one outcome and one chance to win an award), two paylines (generating two outcomes and two chances to win an award), and up to all the paylines. The system links these multiple slot machines each having multiple paylines. The outcomes of the multiple machines compete against each other for a limited number of awards.

In one embodiment, the gaming devices are linked together and game play is synchronized, e.g., for example one game is played every ten seconds. The players in one embodiment opt-in to a play by activating an input such as by pressing a wager button or play button before a counter reaches a designated time, for example five to ten seconds. In the fixed time period, the player can change the wager, for example, the number of paylines played and/or the wager per payline. The player can also elect not to play the next play or event by not activating a play button. In one embodiment, the gaming system generates an outcome for each payline of each linked gaming device regardless of: (i) whether a player is currently playing or wagering on that gaming device, and (ii) whether a player is playing or wagering on each payline.

After an outcome for each payline of each linked gaming device is generated, the gaming system compares and ranks the best or top outcome from each gaming device. That is, for example, the best outcome from paylines one to nine of slot machine one is compared against the best outcome from paylines one to nine of slot machine two, which are compared against the best outcome from paylines one to nine of slot machine n, and so on for each gaming machine in the system. The best or top outcomes are ranked. In one embodiment, the best or top outcome for any given machine is the one that is least likely to occur (i.e., has the lowest probability among the generated outcomes).

A certain percentage of the top rankings each result in an award for the gaming device and potentially for the player playing the gaming device. The top ranked gaming device for example, will receive or be eligible for the top award. The second ranked machine will receive or be eligible for the second best award and so on. For example, if ten machines are linked, the system could make an award available for each of the top five ranked machines, wherein:

(i) the top ranked machine potentially wins 50× bet per ranked payline;

(ii) the second ranked machine potentially wins 10× bet per ranked payline;

(iii) the third ranked machine potentially wins 5× bet per ranked payline;

(iv) the fourth ranked machine potentially wins 2× bet per ranked payline; and (v) the fifth ranked machine potentially wins 1× bet per ranked payline.

The total payout in this example play of the game would be the sum of the payouts which is 68× times the bets played. In this example, the ten slot machines each have nine paylines, and the average payback percentage is calculated based on the odds of a hit occurring. In this example, each separate payline has a 1/90 odds of winning the top award or another designated award. In this example, the one coin or credit payout percentage would be (1/90)*68 which is 75.5%. In one embodiment, this is maintained over all bets at all levels. Such a configuration leaves payback percentage points for bonus games, bonus awards and progressive payouts such as those discussed herein. These paybacks and payback percentages can be adjusted in any suitable manner.

In one example, half the players are playing at 5 coins per line, the other half are playing at 1 coin per line, and all lines are being played. This would result in a coin-in or credit-in of 270 (45*5+45*1). It should be appreciated that if no lines are being played, no payout will occur so this will effect the overall average expected value.

In an example A play of this game, the top five lines are all five coin or one credit players. This play of the game would payout (68×5) which is 340 coins or credits for a payout percentage of 126%.

In an example B play of this game, the top five lines are all one coin or one credit players. This play of the game would pay out (68×1) which is 68 coins or credits which is a payout percentage of 25%.

Examples A and B are the two extremes and their average is (126+25)/2=75.5% which is the same for every payout when all players are betting at the same level. The main difference is that when players are allowed to bet at different levels, the average payout will be met over time, not with every play (as is the case when they are all betting the same level). This can thus provide an extremely volatile game in terms of overall payback percentage. Thus, it should be appreciated that the more evenly the payouts are distributed among the different betting players, the more closely they will resemble the overall average expected value.

In an example C play of this game, the top 5 players have bet as follows:

1) 5 coin player
2) 1 coin player
3) 5 coin player
4) 1 coin player
5) 1 coin player This play of the game pays out (50×5)+(10×1)+(5×5)+(2×1)+(1×1)=288 coins or 106.6%.

In an example D play of this game, the top 5 players have bet as follows:

1) 1 coin player
2) 5 coin player
3) 1 coin player
4) 5 coin player
5) 5 coin player This play of the game pays out (50×1)+(10×5)+(5×1)+(2×5)+(1×5)=288 coins or 44.4%. Again, these two opposite examples result in a payback average of (106.6+44.4)/2=75.5%.

It should thus be appreciated that this game can be very volatile in its payout percentage because of the different bet levels, but can be designed to maintain the correct payout percentage over a period of time. The difference results in that the average expected value would not be maintained with every spin as it would when the players are all betting the same level; but through all of the possible permutations of results, it would maintain the payback percentage.

Since the payout is a multiplier in one embodiment, it would account for the different betting values for each player, but as mentioned above, it can be highly volatile with payouts that could go as low as 15% or as high as 262%. Over time, it would adhere to the average expected value just not with every activation as is the case when all players are betting the exact same amount.

In the above example, if the top ranked result is from a non-active payline, no player receives the top payout of 50× bet per the ranked payline. The award could go unpaid, or in an alternative embodiment go in part or in full to a another award such as a progressive pool instead (e.g., assuming a one credit bet per the non-played or non-active line).

In one embodiment, the comparison or ranking is made according to a series of rules. If two or more machines receive the same ranking, for example, by submitting two or more of the same base outcomes or equally weighted or ranked outcomes, in one embodiment, the system can look to see which of the linked machines has an active payline. If both machines have an active payline, the system looks to the outcome of the next best played or active line of both machines. For example, if machines A and B have the same ranking based on four active payline cherries, machine A has a next best result from an active payline of two cherries and machine B has a next best result from an active payline of three cherries, machine B wins the disputed ranking and machine A receives the succeeding ranking. If machines A and B both have second best active payline outcomes of three cherries, the system compares the third best active payline outcomes and so on until one machine has a better outcome (wins) or runs out of played paylines (loses). In one alternative embodiment, the same ranking results in a split or divided award. Other suitable methods can be used to resolve tie situations.

Following the above example, if the four cherries occurs on an active payline for machine A and a non-active payline for machine B, machine A wins in one embodiment. In another embodiment, the next best result on an active payline of machine A is compared to the next best result (active or non-active) of machine B and so on until one machine has a better outcome (wins) or machine A runs out of played paylines (loses).

Following the above example, if the four cherries occurs on a non-active payline for machine A and a non-active payline for machine B, the next best result of machine A is compared to the next best result of machine B and so on until one machine has a better outcome and wins. In a case in which two machines have the exact same outcome or outcomes, the ranked award could be split for two active machines or provided to one of the machines if it is the only one in which the ranked payline is active.

In one embodiment, each gaming machine plays the same slot or other game. In another embodiment, different gaming devices of the same gaming system play different games such as slot and poker. Here, a one-to-one correspondence exists between outcomes of the different games, the probability of achieving those outcomes and the number of wageable options. For example, each slot machine will have outcomes with the same probabilities as a royal flush, straight, flush, five-of-a-kind, four-of-a kind, etc., and each machine has the same number of wagerable options, such as three paylines or three hands. A valid comparison between play of the different games is thereby possible. In such embodiments, it makes no difference which kind of machine the player plays with respect to the average payback percentage.

The system and method may include any combination of bonus awards, bonus games and progressive payouts. The system and method in one embodiment pays bonus awards for extraordinary outcomes. For example, the system may pay a bonus award of, e.g., 200× instead of 50×, as the top ranked award for receiving five of the same slot machine symbols along an active payline. Or in the game of poker, the system and method may pay a bonus award of, e.g., 1000× instead of 50× for receiving a Royal Straight Flush along an active hand of poker. The system and method can also pay bonus awards to machines receiving the second or third ranked awards, e.g., first ranked machine has a Royal Straight Flush, while second ranked machine, has five-of-a-kind. Here, instead of winning 10× bet, the second ranked player could win 100× bet.

In one embodiment, the system and method also provides one or more bonus games. In an embodiment, the bonus game is a shared bonus game, in which each of the linked gaming devices plays the same bonus game at the same time. For example, the bonus game may be a race with a perceived skill aspect. The race may require the player to make decisions, for example, pass left or pass right; however, the outcomes in one embodiment are generated randomly, regardless of the player's decision or move. The bonus game ranks the bonus game outcomes for each participating machine, just as in the base game sequence. In a bonus environment, each player wins some award in one embodiment, with the top ranked machine receiving the largest award, the bottom ranked machine receiving the smallest award, and so on. Ties (if possible) can be split between the two or more machines or resolved in any suitable manner. Machines not currently being played may or may not participate in the bonus game. Awards made available to the non-played machines may be kept by the house, credited to a bonus pool, redistributed to played machines or employed in any suitable manner.

The system is also adaptable for individual bonus games. Here, one of the gaming devices plays an individual bonus game during which the other machines remain linked in the timed and ranked base game sequence. As soon as the machine completes the individual bonus game, the associated player is able to opt-in to the next wagerable or base game. Base game outcomes can still be generated for machines currently in bonus play in one embodiment. The individual bonus games can also yield ranked outcomes in one embodiment. For example, the individual play can rank the player against fictitious competitors in the bonus game.

In one embodiment, the system provides one or more progressive awards. As mentioned above, in one embodiment, a progressive pool is built through non-collected awards made available to non-active paylines. Part or all of the non-collected award is contributed to the progressive pool. In another embodiment, a percentage of each player's wager is apportioned to build the progressive pool.

The system is adaptable to be implemented centrally. In one such embodiment, virtually all system and individual game processing occurs at a central computer (such as by a central determination system), including: (i) base game outcome generation for each of the paylines of each of the linked gaming devices; (ii) determining for each gaming device which of multiple outcomes is best and ranking the best outcomes; (iii) award outputting; (iv) determining if the award has occurred on an active payline (and whether the player thus wins the award); (v) updating individual credit meters, (vi) tie breaking; (vii) bonus game generation, evaluation, output ranking and award generation; and (viii) incrementing of a progressive pool. Here, the client gaming devices are responsible for displaying results and accepting player inputs.

The system is also adaptable to be implemented at least partially locally. Here, much of the processing occurs at the individual gaming devices, including: (i) base game outcome generation (e.g., reel stop positions) for each of the paylines of each of the gaming device; (ii) best outcome determination; (iii) determining if an available award has occurred on an active payline (and whether the player thus wins the award); (iv) updating the machine's credit meter; (v) bonus game generation; and (vi) incrementing of a progressive pool. Further, one of the gaming devices may be configured to be responsible for collecting the outcomes, ranking the outcomes and propagating the awards to each machine.

The system is further adaptable to distribute the processing responsibilities at any suitable level between the two configurations described herein. For example, instead of the peer-to-peer system in which one of the gaming devices collects and ranks outcomes, a server computer can receive outcomes generated at each machine, collect the outcomes, rank the outcomes and propagate the awards to deserving machines. Either the individual machines or the server computer can be responsible for filtering through each machine's multiple outcomes to determine which outcome is the best outcome for ranking.

The gaming devices each include a video monitor in one embodiment. The video monitors show base game play and results. The system in one embodiment also includes one or more larger shared displays. The video monitors and the shared displays can apportion or overlap the display of the outcome ranking and award generation as desired. For example, the larger displays can list each of the outcomes in ranked order so that each player can see what the other machines obtained. The awards are then shown on the individual video monitors of deserving machines.

One advantage is to provide a fun and exciting gaming system.

Another advantage is to provide a gaming system in which the constituent gaming machines compete for limited awards.

A further advantage is to provide a gaming system in which the constituent gaming machines play in sync.

Another advantage is to provide a gaming system in which the constituent gaming machines can win bonus awards, progressive awards and/or play bonus games.

A further advantage is to provide a gaming system in which the constituent gaming machines play a competing bonus game.

Another advantage is to provide a gaming system that is well-suited for centralized outcome generation.

A further advantage is to provide a gaming system that employs one or more common video monitors.

Moreover, another advantage is to provide a gaming system that may be implemented in physical gaming machines at a casino or over a data network.

A further advantage is to provide a gaming system that may be retrofitted to existing gaming machines.

Additional features and advantages of the system and method are described in, and will be apparent from, the following Detailed Description and the figures.

BRIEF DESCRIPTION OF THE FIGURES

FIG. 8 is a schematic table illustrating matching symbol combinations for poker and slot that may both be played via the ranked multiplayer gaming system.

DETAILED DESCRIPTION

The Gaming System Generally

The present disclosure provides a gaming system and method in which multiple gaming devices or gaming machines are linked. The system and method can also be implemented over a data network such as an internet. The system and method can be implemented with multiple types of wagering games, such as slot, poker, blackjack, keno, roulette, or any other suitable base or primary wagering game or with any suitable bonus or secondary game. The system and method is generally applicable to any type of game involving multiple players, in which the game generates outcomes that can be ranked. If the gaming machines have multiple wagerable options, such as slot paylines, the system and method ranks the outcomes two times: (i) a first ranking to choose the best outcome for each gaming machine and (ii) a second ranking that ranks the best outcomes for all of the machines of the system.

Figure 1:
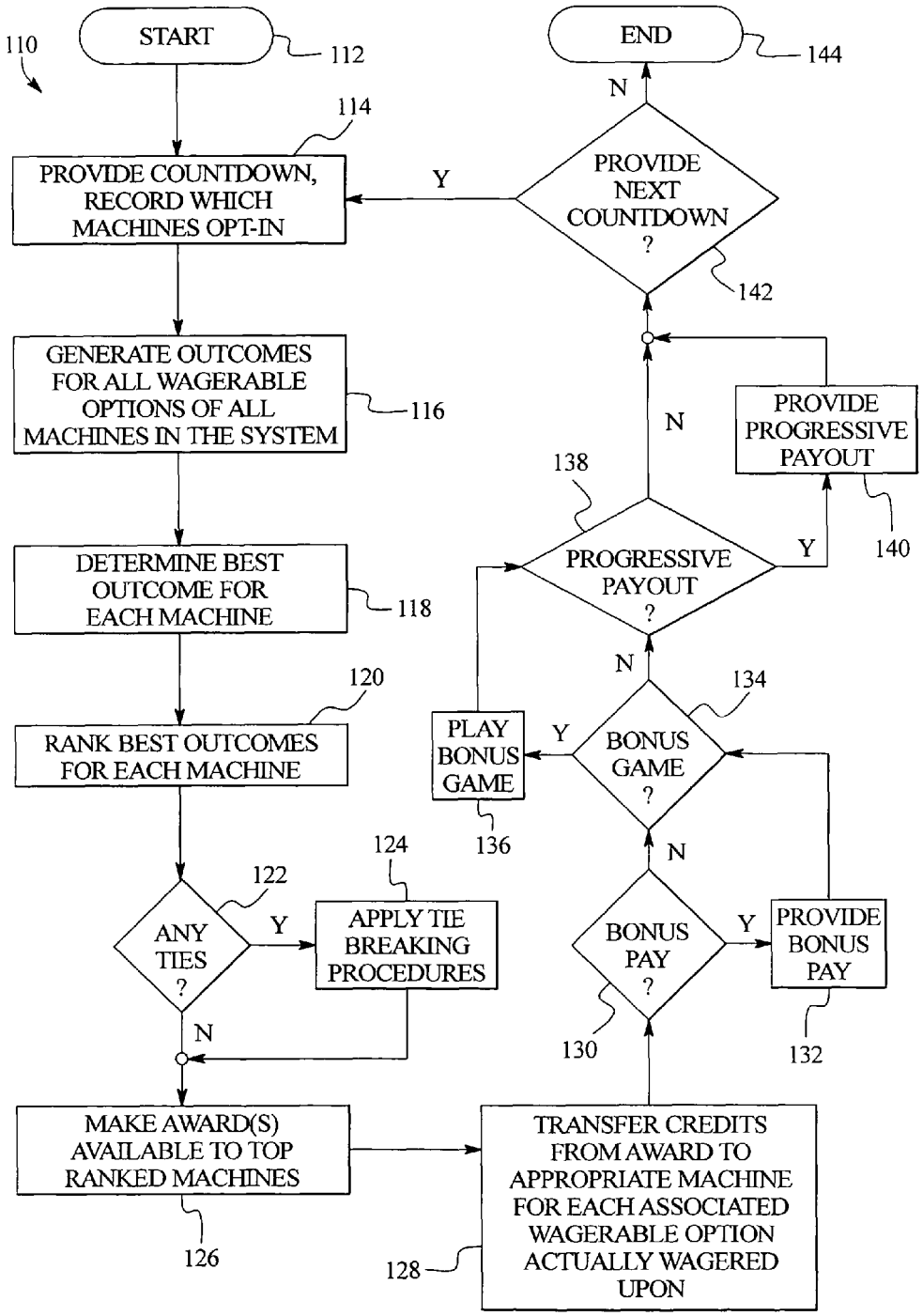
FIG. 1 is a schematic flow diagram illustrating one algorithm or method of operation of one embodiment the multiplayer gaming system.

Referring now to the drawings and in particular to FIG. 1, one algorithm or method of operation for the multiplayer wagering system (referred to herein and shown in FIGS. 4 and 5 as system 100) is illustrated via method 110. Upon beginning the method or algorithm (as indicated by oval 112), the system provides a countdown during which gaming machines (or internet players) linked to the system can join or opt-in to the next simultaneous play. The system records which machines (and, e.g., which paylines of those machines) are active or wagered upon (as indicated by block 114). The countdown also provides players with time to change their wager, e.g., to wager more or less paylines or more or less per payline.

At the end of the countdown, the system generates base game outcomes (e.g., for slot, poker, blackjack, keno or roulette) for all wagerable options (e.g., paylines, hands, or plays) of all machines connected to the system (as indicated by block 116). This is done in one embodiment, regardless of how many of the options have actually been wagered upon. As described in detail below, the base game outcomes may be generated locally (e.g., via the processors of the gaming devices) or remotely (e.g., at a central server).

Depending upon the type of game implemented with the system, multiple outcomes for the same machine may be generated upon each simultaneous game play. For example, many slot machines enable wagering on multiple paylines for one spin of the reels. Many poker machines allow multiple hands of poker to be played at once. In such cases each machine or player will obtain multiple outcomes. The system determines and selects the best outcome from the multiple outcomes for each machine or player (as indicated by block 118). The best outcome in one embodiment is the outcome having the lowest probability of occurrence.

The system ranks the best outcomes from all machines in the system (as indicated by block 120). If one or more tie occurs (diamond 122), the system applies one or more tie breaking procedure (as indicated by block 124). Different tie breaking procedures are discussed herein. After the tie breaking procedure is applied, or if no tie occurs, the system makes at least one award available to at least the top ranked machine (as indicated by block 126). The system in one embodiment displays which awards have been made available to which machines for example, on a large video monitor(s) visible to players playing the machines linked to the system.

The system transfers credits in accordance with the awards to the appropriate credit meters of machines for which the players have actually wagered on the wagerable options leading to the outcomes generating the awards (as indicated by block 128). That is, for example, if the player has actually wagered on a payline leading to the top ranked outcome, the system provides the player the award associated with the top ranked outcome. If the player has not wagered the payline leading to the top ranked outcome (e.g., plays a different payline), the system does not provide that player the associated award. If the associated machine is not currently being played, the system does not provide the associated award to the non-played machine.

The system provides extra gaming features, such as bonus awards (diamond 130, block 132), bonus games (diamond 134, block 136) and progressive payouts (diamond 138, block 140). In one embodiment, the base game payback percentage is set to allow for such extra gaming features. The system provides bonus awards, for example, when a base game outcome is extraordinary or at or above a designated level (e.g., five of the same symbol along a single slot machine payline or a straight flush in poker). The bonus award can increase the set payout (e.g., from 50× to 1000×).

Regarding bonus gaming, the system may generate results for a bonus game, like the base game, locally or remotely. The bonus game in one embodiment is played by all machines or players in the system and evaluated according to outcome ranking, as with the base game. Bonus awards may be made available to some or all of the machines (e.g., in varying amounts).

The system in one embodiment builds a progressive pool using a percentage of the wagers placed by the players. An extraordinary base game outcome or such outcome in combination with an extraordinary bonus game outcome triggers the progressive payout.

After the extra gaming features are evaluated, the system provides the next countdown (diamond 142, block 114) or is shut down (oval 144). In one embodiment the system is timed to automatically run a simultaneous play of the relevant wagering game or games (e.g., once every ten to fifteen seconds). The system provides a certain amount of time for the countdown and a certain amount of time for outcome and award generation and display. For example, the system may provide five to ten seconds after the last game play for the player to change and/or place a wager. That period is followed by another game play and award distribution sequence, and so on. Bonus play in an embodiment interrupts base game play for all machines in the system.

Gaming Devices Generally

The system may be implemented over a data network, such as the internet. The system may also be implemented in one or more types of wagering games, such as slot, poker, keno, roulette and the like. The system is generally applicable to any type of game involving multiple players, in which the game generates outcomes that can be ranked. To that end, the game may comprise any suitable reel-type game, card game, number game or other game of chance susceptible to representation in an electronic or electromechanical form, which produces a random outcome based on probability data or random number generator.

In one preferred embodiment, the system is implemented in a plurality of linked slot machines. For convenience, much of the system and method disclosed herein is described using slot machines as an example. It should be kept in mind however when reading the specification that the teachings exemplified via the slot machine description are applicable to any of the above-listed machines or types of machines.

Figure 2A:
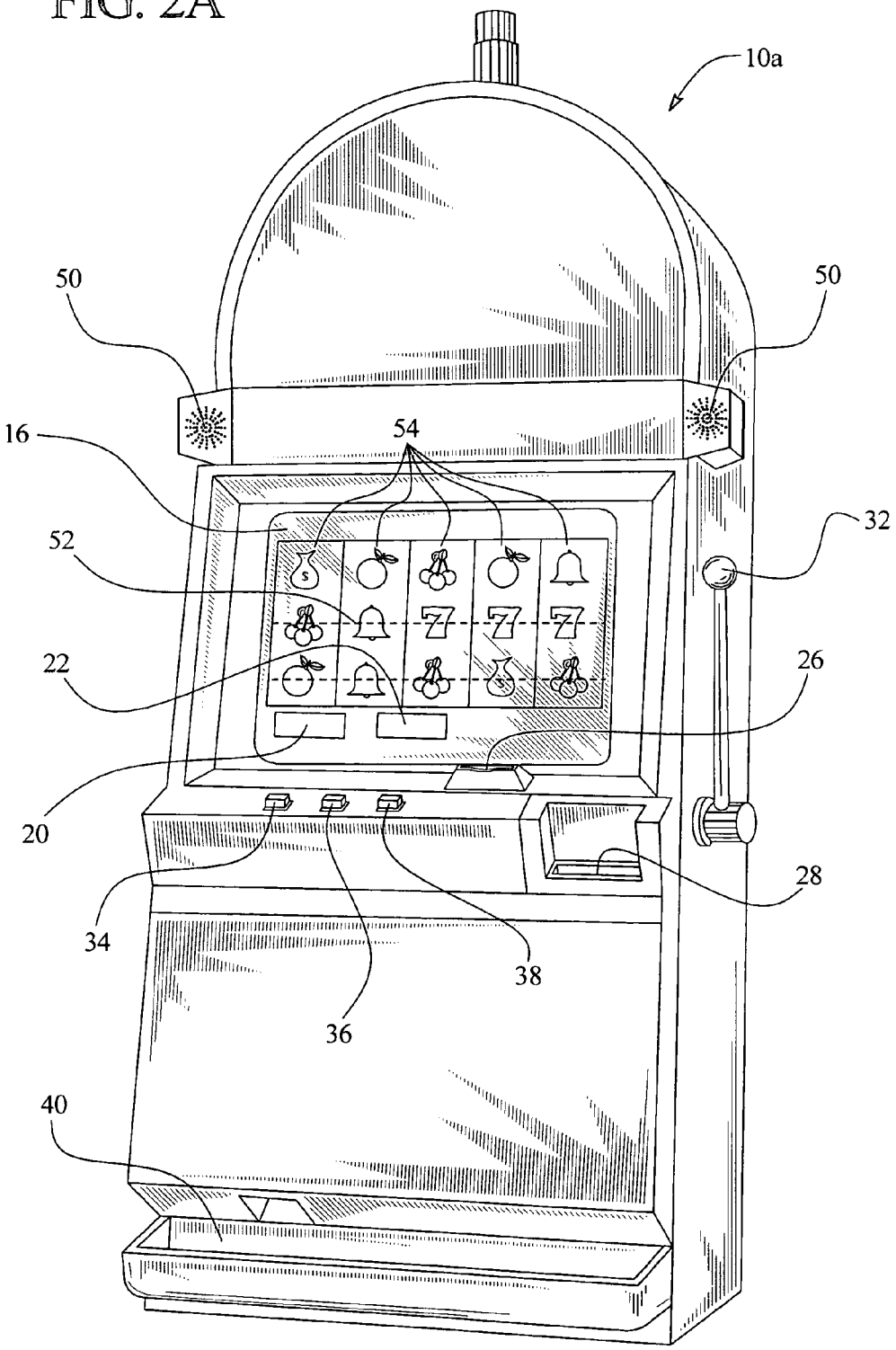
FIG. 2A is a front perspective view of one embodiment of the gaming device implemented on the system.
Figure 2B:
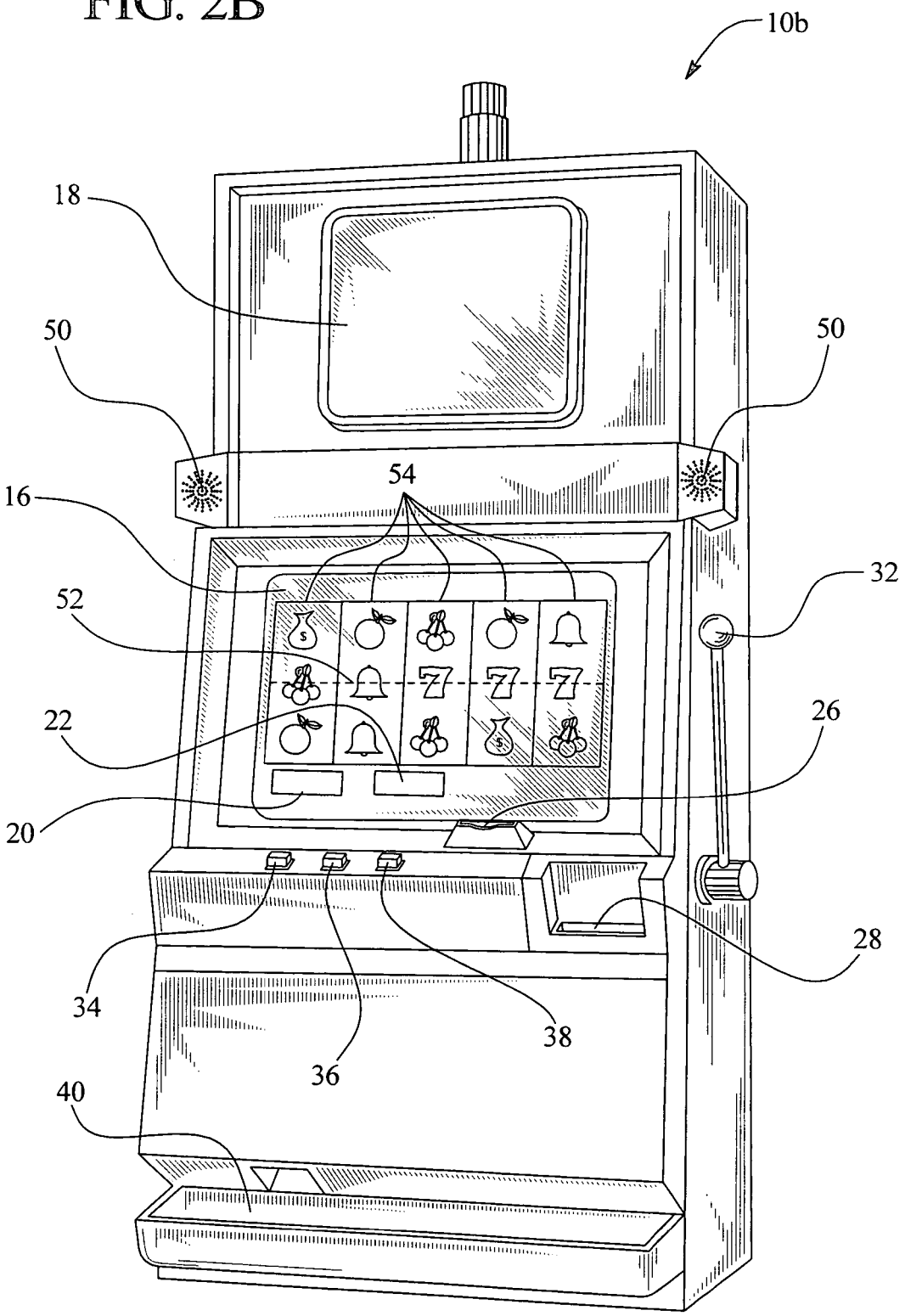
FIG. 2B is a front perspective view of another embodiment of the gaming device implemented on the system.
Figure 3:
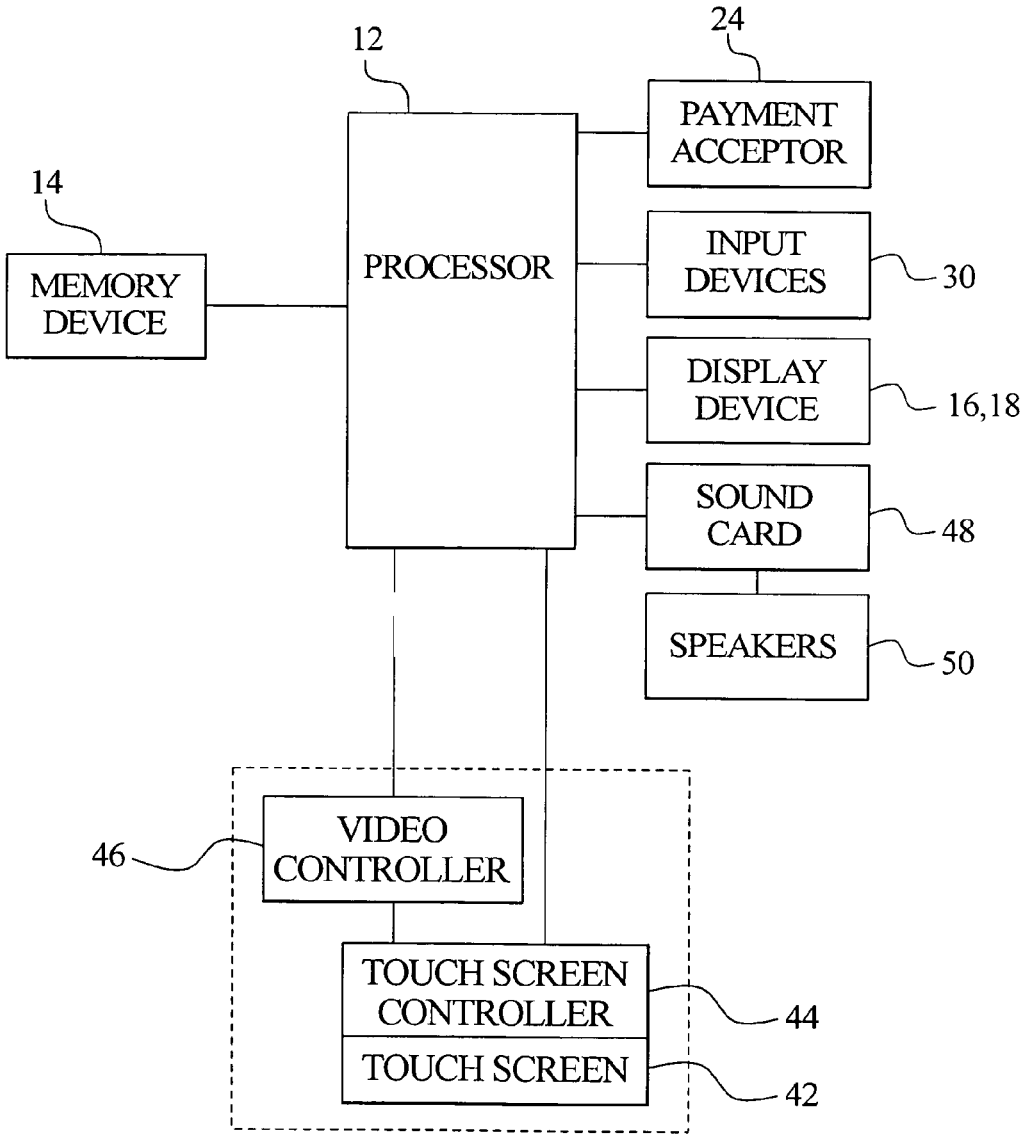
FIG. 3 is a schematic block diagram of one embodiment of an electronic configuration for one of the gaming devices implemented on the system.

Referring now to FIGS. 2A, 2B and 3, two alternative embodiments of a gaming device for implementing the system are illustrated as gaming device 10*a* and gaming device 10*b*, respectively. Gaming device 10*a* and/or gaming device 10*b* are generally referred to herein as gaming device 10. Many of the components discussed below for gaming device 10 are applicable regardless of whether gaming device 10 is a slot machine, poker machine, blackjack machine, keno machine, roulette machine or any other suitable machine. Certain features are specific to slot machines but have analogous structure in other types of machines. For example, slot machines have multiple paylines, which are analogous to multiple wagerable hands of poker or blackjack, multiple simultaneous plays of keno, and multiple roulette numbers played simultaneously.

In one embodiment, as illustrated in FIGS. 2A and 2B, gaming device 10 has a support structure, housing or cabinet that provides support for a plurality of displays, inputs, controls and other features of a conventional gaming machine. Gaming device 10 is configured to be operated by a player standing or sitting. The gaming device may be positioned on a base or stand or be configured as a pub-style table-top game (not shown), which a player can operate while sitting. As illustrated by the different configurations shown in FIGS. 2A and 2B, gaming device 10 can be constructed with varying cabinet and display configurations.

In one embodiment illustrated in FIG. 3, gaming device 10 includes at least one processor 12, such as a microprocessor, a microcontroller-based platform, a suitable integrated circuit or one or more application-specific integrated circuits (ASIC's). Processor 12 is in communication with or operable to access or to exchange signals with at least one data storage or memory device 14. In one embodiment, processor 12 and memory device 14 reside within the cabinet of gaming device 10. Memory device 14 stores program code and instructions, executable by processor 12, to control gaming device 10. Memory device 14 also stores other data such as image data, event data, player input data, random or pseudo-random number generators, pay-table data or other operating data, information and applicable game rules that relate to the play of gaming device 10.

Memory device 14 includes random access memory ("RAM") and read only memory ("ROM") in one preferred embodiment. Alternatively or additionally, memory device 14 includes flash memory and/or EEPROM (electrically erasable programmable read only memory). Any other suitable magnetic, optical and/or semiconductor memory may be implemented in conjunction with gaming device 10 of the present system and method.

In one embodiment, part or all of the program code and/or operating data described above can be stored in a detachable or removable memory device, including but not limited to, a suitable cartridge, disk or CD ROM. A player can use such a removable memory device in a desktop, a laptop personal computer, a personal digital assistant ("PDA") or other computerized platform.

In one embodiment, processor 12 of gaming device 10 controls one or more display devices 16, 18. Display devices 16, 18 are connected to or mounted to the cabinet of gaming device 10. The embodiment shown in FIG. 2A includes a central display device 16, which can display a primary or base game, e.g., the typical game of slot, poker, keno, roulette, etc. Display device 16 may also display any suitable bonus or secondary game associated with the primary game as well as information relating to the primary and/or secondary game. The alternative embodiment shown in FIG. 2B includes a central display device 16 and an upper display device 18. Upper display device 18 may additionally or alternatively display the primary game, any suitable secondary game associated with the primary game and/or information relating to the primary or secondary game.

Display devices 16 and 18 may include without limitation, a monitor, a television display, a plasma display, a liquid crystal display ("LCD"), a display based on light emitting diodes ("LED") or any other suitable electronic device or display mechanism. In one embodiment, as described in more detail below, display device 16 or 18 includes a touchscreen 42 with an associated touchscreen controller 44. Display devices 16 and 18 may alternatively or additionally include mechanical or electromechanical components, such as reels 34 and wheels. The Display devices 16 and 18 may be of any suitable size, shape or configuration.

Display devices 16 and 18 of gaming device 10 are configured to display one or a plurality of games or other suitable images, symbols and indicia, such as any visual representation or exhibition of the movement of objects. Display devices 16 or 18 may have mechanical, virtual or video reels and wheels, dynamic lighting, video images and images of people, characters, places, things, faces of cards, tournament advertisements, promotions and the like.

In one embodiment, the symbols, images and indicia displayed on or by display devices 16 or 18 are in mechanical or electromechanical form. That is, display devices 16 or 18 may include any suitable electromechanical device, which moves one or more mechanical objects, such as one or more mechanical rotatable wheels or reels 34 that each display at least one image, symbol or indicia.

As seen in FIGS. 2A and 2B, in one embodiment gaming device 10 includes a credit display 20, which displays a player's current number of credits, cash, account balance or the equivalent. In one embodiment, gaming device 10 includes a bet display 22 which displays a player's amount wagered.

As illustrated in FIG. 3, in one embodiment, gaming device 10 includes at least one payment acceptor 24 in communication with processor 12. As seen in FIGS. 2A and 2B, payment acceptor 24 may include a coin slot 26 and a payment, note or bill acceptor 28, in each of which the player inserts money, coins or tokens. The player can place coins in the coin slot or paper money, ticket or voucher into the payment, note or bill acceptor. In other embodiments, devices such as readers or validators for credit cards, debit cards, data cards or credit slips could be used for accepting payment.

As seen in FIGS. 2A, 2B and 3, in one embodiment gaming device 10 includes at least one input device 30 (generally) that communicates with processor 12. Input devices 30 can include any suitable apparatus that enables the player to produce an input signal read by processor 12. Input device 30, for example, can be a game activation device, such as a pull arm 32 or a play button 34. The player activates such input device to start a primary game or sequence of events in gaming device 10. Play button 34 can be any suitable play activator such as a bet one button, a max bet button or a repeat bet button.

As discussed in detail below, the system in one embodiment generates results on one or both of gaming devices 16 and 18 regardless of whether or not the player has placed a wager. The results can be generated on, a timed basis, e.g., once every five or ten seconds. Play button 34 enables a player at gaming device 10 to opt-in to the next random generation. By opting-in the player places one or more wager on a wagerable component, such as a slot machine payline, hand of poker, etc.

In one embodiment gaming device 10 includes a bet one button 36. The player increases his or her bet by one credit, for example, each time the player pushes bet one button 36. When the player pushes the bet one button, the number of credits shown in credit display 20 decreases by one, and the number of credits shown in bet display 22 increases by one. Other input devices 30 may be provided, such as a bet max button (not shown). The max bet button enables the player to bet the maximum wager permitted for a game associated with gaming device 10 (e.g., max coins on all paylines of a slot machine). The system enables the player via the max bet button and other wager changing input devices 30 to change the wager during the opt-in period.

Gaming device 10 also includes a cash out button 38. The player pushes cash out button 38 to receive a cash payment or other suitable form of payment corresponding to the number of remaining credits shown in credit display 20. In one embodiment, when the player cashes out, the player receives coins or tokens in a coin payout tray 40. In another embodiment, when the player cashes out, the player receives another type of payout mechanism, such as a ticket or credit slip, which is redeemable by a cashier or is funded to the player's electronically recordable identification card. The system can allow the player to cash out (i) at any time or (ii) only during the opt-in period.

As mentioned above and seen in FIG. 3, a touchscreen 42 or other type of touch-sensitive display overlay may be provided, which operates with a touchscreen controller 44 to allow the player to interact with the images on display device 16 or 18. Touchscreen 42 and touchscreen controller 44 operate with a video controller 46. A player can make decisions and input signals into gaming device 10 by touching touchscreen 42 at appropriate places.

Gaming device 10 in an embodiment includes a plurality of communication ports for enabling communication between processor 12 and external peripherals, such as a server or central determination computer, external video sources, expansion buses, game or other displays, an SCSI port or key pad.

In one embodiment processor 12 communicates with one or more sounds cards 48. Sound card 48 operates with at least one speaker 50 and/or other sound generating hardware and software to generate sounds, such as voice or music for the primary and/or secondary game or for other modes of gaming device 10, such as an attract mode. Gaming device 10 is configured to provide dynamic sounds that couple with attractive multimedia images displayed on display devices 16 and/or 18 for base or bonus play. During idle periods, gaming device 10 may display a sequence of audio and/or visual attraction messages to attract potential players to gaming device 10. The audio/video outputs also provide any desired customized information, such as game play and paytable information. To that end, processor 12 may operate multiple imbedded screens, such as a game play or paytable screen that the player can recall selectively, e.g., by touching indicia on touchscreen 42 corresponding to the game play or paytable screen.

In one embodiment, gaming device 10 includes a camera (not illustrated) that communicates with processor 12. The camera is positioned to acquire an image of a player playing gaming device 10 and/or the surrounding area of gaming device 10. The camera can selectively acquire still or moving (e.g., video) images in an analog, digital or other suitable format. Gaming device 10 is further configured to display the camera images and the game in split-screen or picture-in-picture fashion on display device 16 and/or 18. For example, the camera may acquire an image of the player, after which that image is incorporated into the primary and/or secondary game as, e.g., a background image, game symbol or indicia.

The Individual Processors

As discussed herein, individual processors 12 of gaming devices 10 of system 100 may or may not generate base and bonus game outcomes. Processor 12 in any event will control the operation of the above-listed apparatuses in FIGS. 2A, 2B and 3 at least somewhat. For example, processor 12 will receive inputs from the various input devices, including the play button 34 that enables the player to opt-in to the next play. Processor 12 enables the player to change the player's wager, add money to gaming device 10, cash out from gaming device 10. Processor 12 responds to inquiries from the player, e.g., for paytable or game operation information.

Processor 12 commands display devices 16 and 18 and speakers 50 to communicate the results of game play (e.g., actual outcome, rank of outcome, missed award opportunities and awards actually provided), bonus play, bonus pay and progressive pay. To the extent desired by the game implementers, processor 12 can receive information concerning the outcomes from other gaming devices 10 of system 100 and cause such information to be displayed on one of the display devices. For example, if the top five results are each eligible for an award, processor 12 can be programmed to display the top five outcomes on display device 16 or 18 in addition to the actual outcome for the gaming device 10 assuming the actual outcome is not one of the top five outcomes.

Processor 12 also calculates the award that the player receives. For example, if one of the top ranked outcomes is generated for an active payline 52 along reels 54 of slot machine 10, slot machine 10 and the associated player receive an award. As discussed herein, the award may be in the form of a multiplier that multiplies a number of coins wagered, for example, the number of coins wagered on the payline. Many slot machines enable one to five coins to be wagered on any payline. If the award is a 50× multiplier, the player's ultimate award may range from fifty coins to two-hundred fifty coins depending on the wager made for the winning payline. Processor 12 performs this calculation and updates credit display 20 accordingly.

System with Linked Gaming Devices and Central Processor

Figure 4:
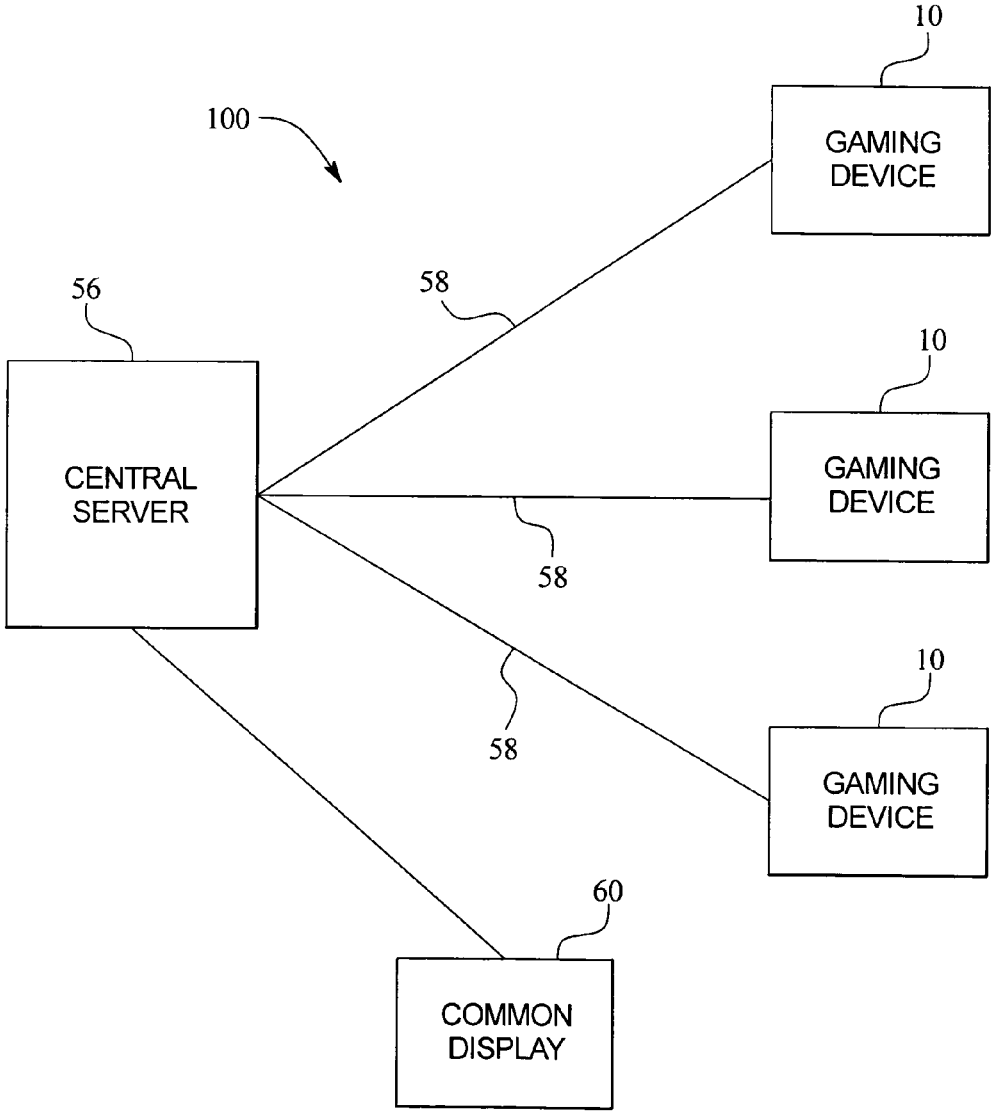
FIG. 4 is a schematic block diagram of one embodiment of a network configuration for a plurality of gaming devices implemented on the system.

As illustrated in FIG. 4, system 100 includes a plurality of the above described gaming devices 10, which in one embodiment are each linked to a data network via a remote communication link 58. Gaming devices 10 in the illustrated embodiment are connected via link 58 in a spoke-and-hub type fashion with a central server 56. More specifically, processor 12 of each gaming device facilitates transmission of signals between individual gaming devices 10 and central server 56. Central server 56 can operate a single cluster of machines 10 or multiple ones of such clusters. Central server 56 also operates one or more common displays 60 in one embodiment.

Central server 56 in one embodiment is located physically separately from each of gaming devices 10. Central server 56 can be located out on the casino floor with gaming devices 10 of system 100 or elsewhere in the casino. In a further alternative embodiment, central server 56 is located remotely from gaming devices 10. In certain embodiments, when system 100 is implemented via a data network such as the internet, gaming devices 10 can be personal computers, link 58 is the internet and central server 56 can be located in a different state or country.

In another embodiment, a processor of one of gaming devices 10 performs the function of central server 56. In this peer-to-peer type of system, one of the machines 10 takes responsibility for collecting outcomes from the other machines 10, ranking those outcomes and propagating the awards from the ranking to the machines and overhead displays. The processor within the responsible gaming device that collects and ranks the outcomes can (i) be processor 12, (ii) be a different processor located within the gaming device (e.g., on a same or different printed circuit board with processor 12), or (iii) even be central server 56 (e.g., with base game outcome generation capability). Hereafter, system 100 will be described via a separate central server 56. It should be appreciated however that the following teachings are also applicable to the peer-to-peer system, in which a processor within one of gaming devices 10 is the responsible processor just described. It should also be appreciated that the outcomes and/or results can be generated by a central determination gaming system having fixed nods of outcome and/or results as discussed below.

Data Networking

The data network of link 58 is in one embodiment a local area network ("LAN"), in which gaming devices 10 of system 100 are in communication with an on-site central server 56. Gaming devices 10 of system 100 may be located in one part of a casino or in clusters in different parts of the casino. The LAN may be implemented via conventional phone or other data transmission line, digital signal line ("DSL"), T-1 line, coaxial cable, fiber optic cable, wireless ("e.g., radio frequency") gateway or other suitable connection.

In another embodiment, the data network of link 58 is a wide area network ("WAN"), in which gaming devices 10 are in communication with at least one off-site central server 56. In this embodiment, the plurality of gaming devices may be located in a different part of the gaming establishment or within a different gaming establishment than the off-site central server. The WAN may be implemented via conventional phone or other data transmission line, digital signal line DSL, T-1 line, coaxial cable, fiber optic cable, wireless (e.g., "radio frequency") gateway or other suitable connection.

In a further embodiment, the data network of link 58 is an internet or intranet. Here, the operation of gaming device 10 is viewed via at least one internet browser. Operation of gaming device 10 and accumulation of credits may be accomplished via a connection to the central server 56 (the internet/intranet server or webserver), such as a conventional phone or other data transmission line, digital signal line DSL, T-1 line, coaxial cable, fiber optic cable, wireless (e.g., "radio frequency") gateway or other suitable connection. Here, players may access system 100 via an internet game page and from any location in which an internet connection or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications particularly if such communications are encrypted. Higher data transmission speeds may be useful for enhancing the sophistication and response of the display and interaction with the player.

Networking for Progressive Pools

Central server 56, via the LAN, WAN or internet network, is operable to build and distribute one or more progressive pool of funds. It is known in the art to apply a portion of each wager placed to initiate a base or primary game to such progressive pool. The pool builds until a triggering event causes the pool of funds to be distributed. With system 100, the pool of funds can be distributed to a single machine or player or to multiple machines or players, e.g., according to the ranking of base and/or bonus game outcomes.

For larger, multi-site linked progressive pools, central server 56 can (i) communicate with or (ii) operate as a host site server, which is coupled to a plurality of local servers at a variety of mutually remote gaming sites. The host site server collects funds from and services gaming devices distributed throughout a number of properties at different geographical locations including, for example, different locations within a city or different cities within a state. In an embodiment, the host site server oversees the entire progressive gaming system and is the master processor for computing progressive jackpots. All participating gaming sites report to, and receive information from, the host site server. The host cite server can be different than central server 56. Here, central server computer 56 is responsible for communicating data between gaming devices 10 of system 100 and the host site server.

Central Server Determination of Base Game Outcomes

In one embodiment, central server 56 of system 100 generates the base game outcomes (e.g., slot, poker, keno or roulette outcomes) for the constituent gaming devices 10. Here, processors 12 do not operate directly with an on-board random number generator to produce random outcomes at the individual gaming devices. Instead, central server 56 employs one or more random number generators to determine random outcomes for each of gaming devices 10 of system 100. Processor 12 receives the outcome generated randomly at central server 56 and displays the outcome to the player on display device 16, 18. For example, if gaming device 10 is a slot machine, processor 12 receives a reel stop position outcome generated randomly at central server 56 and causes reels 54 to spin and stop at that reel stop position. Likewise, if gaming device 10 is a poker machine, processor 12 receives a poker hand outcome generated randomly at central server 56 and causes display device 16 or 18 to generate that poker hand.

In one embodiment, upon an initiation (e.g., at the end of the countdown described above in connection with FIG. 1) of a group game play, each gaming device 10 of system 100 sends an outcome request over link 58 to central server 56. In one embodiment, each of the gaming devices 10 sends an outcome request to central server 56 regardless of whether the gaming device is being played or not (is active or non-active). In another embodiment only the currently played or active gaming devices 10 send outcome requests to central server 56, although, in one embodiment outcomes are determined for the unplayed gaming machines.

Central server 56 receives the game outcome requests, for example at the end of a countdown, and generates game outcomes for each of the requesting machines. Central server 56 also determines if a bonus award is generated for one or more of the gaming devices 10. For example, if the highest ranked machine has achieved an unusually unique or low probability outcome, central server 56 determines that the gaming device 10 is eligible for a bonus payout and sends a message to processor 12 of that gaming device 10. The gaming device 10 can display a suitable bonus payout message to the player on display device 16 or 18 and/or provide a suitable audio message via speakers 54. The bonus award can also be communicated to other players, e.g., via common display 60.

Central server 56 also determines if system 100 or any of its gaming devices 10 have entered a bonus mode. In an embodiment each of the gaming devices 10 of system 100 plays a bonus game at the same time, the outcomes of which are ranked. Awards are made according to the outcome rankings in a similar manner as with the base game analysis. Central server 56 performs these functions and determines when the bonus has been triggered. The bonus can be triggered when each of (or a threshold amount of) the gaming devices generates the same outcome, e.g., a bonus outcome. Or, the bonus is triggered if the overall outcomes for the gaming devices 10 reach a threshold level (e.g., each machine receives at least two cherries in slot or at least one pair in poker). In any case, central server 56 determines when this occurs and begins the bonus game. Central server 56 stores the program code, random number generators and any data necessary to perform these functions.

For base game outcome generation, central server 56 in one embodiment generates base game outcomes using probabilities and at least one random number generator. According to the probability data, it is more likely that central server will generate, for example, two cherries versus three cherries in slot or one pair versus two pair of cards in poker. There is no limitation however on the amount of times that any particular outcome can be generated randomly. Over time, the outcomes should be generated in a frequency based on their associated weighted probabilities.

For base game outcome generation, central server 56 in another embodiment maintains one or more predetermined pools or sets of predetermined game outcomes. Here, central server 56 receives the outcome requests from the gaming devices 10 and randomly selects predetermined game outcomes from the set or pool of game outcomes. Central server 56 then flags or marks the selected game outcomes as used. Once flagged as used, central server 56 cannot thereafter select the flagged outcomes after subsequent countdowns. Eventually, when all outcomes of the set or pool are selected and flagged, the sequence is reset and all outcomes become eligible.

After the countdown and outcome generation, central server 56 communicates the generated or selected base game outcomes to the gaming devices 10. The gaming devices receive the generated or selected game outcomes and display a corresponding visual and/or audio presentation on the display devices 16 or 18 and/or speakers 50. How the generated or selected game outcomes are to be presented or displayed on the display devices 16 or 18 and/or speaker, such as a reel symbol combination of a slot machine or a hand of cards dealt in a card game, can be determined by central server 56 or the individual game processors 12. Centralized production or control of base game outputs can assist a gaming establishment or other entity in maintaining appropriate records, controlling gaming, reducing and/or preventing cheating or electronic or other errors, reducing or eliminating win-loss volatility and the like.

Base and Bonus Game Outcomes Determined Locally

In another embodiment, central server 56, as above: (i) runs the countdown, compares and ranks the base game outcomes; (ii) makes available the limited awards to certain ones of the gaming devices; (iii) distributes the awards to the active gaming devices; (iv) performs record keeping; (v) provides common bonus games; (vi) provides additional bonus payouts; (vii) runs or cooperates in a progressive system; (viii) coordinates player tracking and other player profile information; and (ix) operates any large, common display. Processor 12 of each individual gaming device 10 here however generates the base game outcomes. That is, processor 12 does not send out an outcome request to central server 56 as above, after which central server 56 generates the outcomes and communicates same to the processors 12 of the gaming devices 10 of system 100. Here instead, after the countdown the processors 12 generate outcomes randomly, for example according to on-board probabilities and random number generator and send the base game outcomes to central server 56 for comparison and ranking.

Regarding bonus game play, in one embodiment system 100 plays bonus games on each of the constituent gaming devices 10. Base game play stops for a number of countdowns while the bonus game is played. After the bonus game is played, bonus awards are distributed and a new base game countdown begins. Under such simultaneous play it is still contemplated that individual processors 12 can generate the bonus game outcomes for comparison by central server 56.

In the system 100 central server 56 controls certain bonus games, while individual processors can control others. For example, if system 100 includes fifty gaming devices 10, and the bonus game is, for example, a race in which each gaming device finishes somewhere from first place to fiftieth place, central server 56 can implement the bonus game, which itself pits each gaming device 10 against the others. On the other hand, if the bonus game is, e.g., a three-point shooting contest, each processor 12 can run its own bonus game, albeit at the same time as the other gaming devices 10 run their respective three-point shooting bonuses. Local processors 12 send the three-point shooting outcomes to central server 56 for comparison. It should be appreciated however that, just like with the base game outcomes, the three-point shooting outcomes could be determined centrally and communicated to processors 12 of the respective gaming devices 10.

In one embodiment the bonus game outcomes are analyzed relative to each other. The race game example described above presents a situation in which every outcome, first place to last place, is guaranteed to be assigned to one of the machines. The three-point shooting bonus is more akin to the base games, wherein a perfect score, like five slot symbols or a royal straight flush is not guaranteed and indeed may be very unlikely to occur. Here, the base and bonus games lend themselves to bonus pays for extraordinary results, such as a royal straight flush in poker, five sevens in slot or a perfect ten makes out of ten tries in a three-point shooting bonus game.

Gaming Functions Determined Locally or Centrally

As discussed herein, many gaming functions can be performed locally or centrally as desired by the system implementers. For example, player tracking and profiling can be maintained locally or centrally. If a ticketing system is employed it may operate with processors 12 (more likely) or central server 56. Processor 12 and central server 56 may cooperate to provide audio and video displays in accordance with a theme of the gaming devices.

Figure 5:
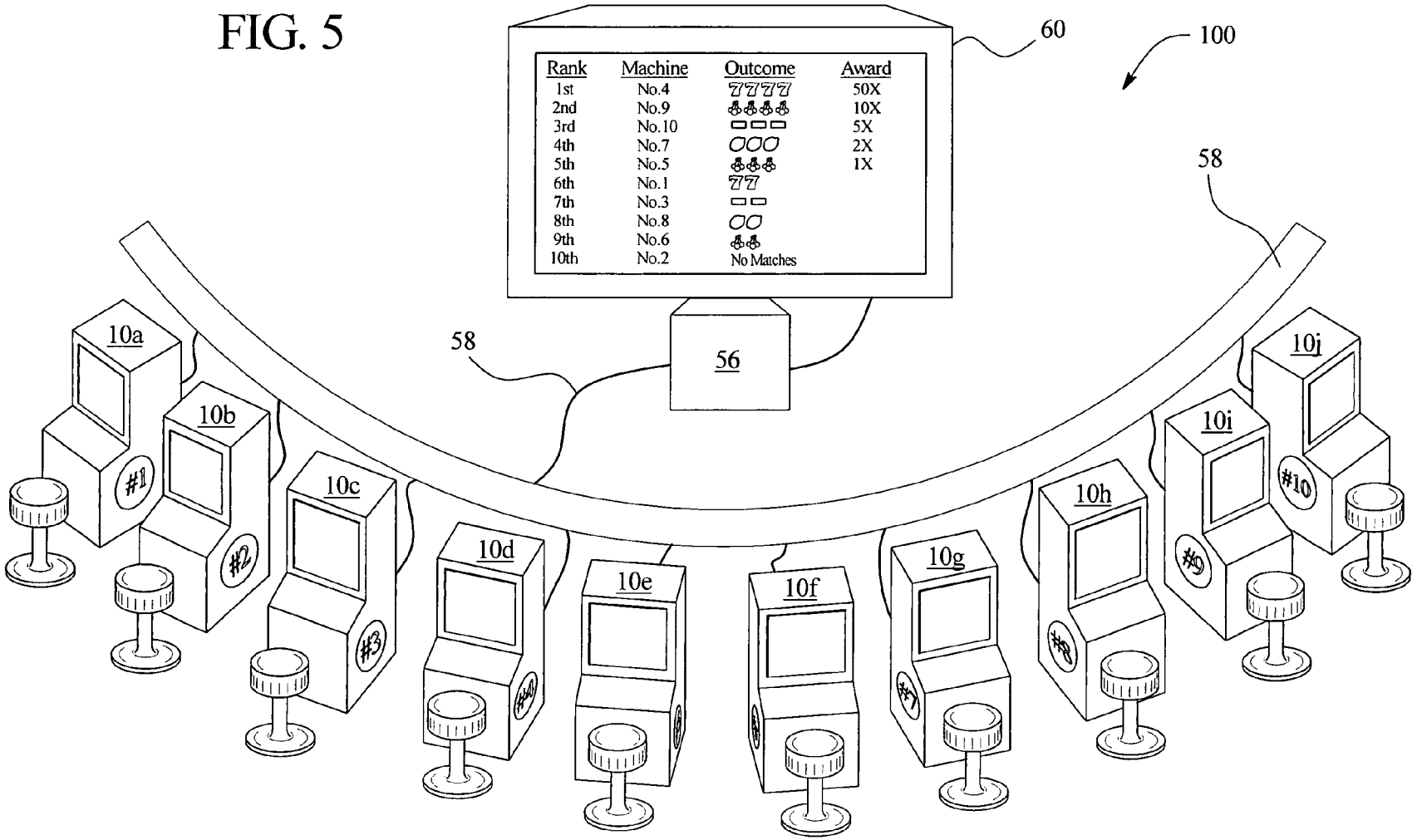
FIG. 5 is a perspective view of a plurality of slot machines that are linked via the multiplayer gaming system and a large display cooperating with the gaming machines.

As illustrated in FIGS. 4 and 5, central server 56 of system 100 operates in one embodiment with at least one larger common display 60, which may be positioned overhead of gaming devices 10. Common display 60 may be any suitable type of monitor or television display, for example a plasma display, LCD, LED or other suitable display. Common display 60 may be of any suitable size, for example sixty inches measured diagonally.

Common display 60 in an embodiment (either alone or with display devices 16 or 18) shows the countdown to the next simultaneous game play. Display 60 can show numbers counting backwards visually and/or audibly, e.g., "ten," "nine," "eight," "seven," "six," "five," "four," "three," "two," "one," "spin" ("deal," "draw," etc.). In that time the player has to decide whether to opt-in to the next play and to make any changes to the player's wager.

After the countdown and if the cluster of machines 10 of system 100 is small enough to enumerate efficiently, common display 60 in an embodiment (either alone or with display devices 16 or 18) can show a number and/or color corresponding to each machine 10 of system 100 and each machine's associated best outcome. In an embodiment, display 60 shows the outcomes ranked and any associated awards. For example, if system 100 includes ten machines, the top five of which become eligible for awards, display 60 could show the following after a simultaneous game play.

| Rank | Machine | Outcome | Award |
|---|---|---|---|
| 1st | No. 04 | four sevens | 50X |
| 2nd | No. 09 | four cherries | 10X |
| 3rd | No. 10 | three bars | 5X |
| 4th | No. 07 | three lemons | 2X |
| 5th | No. 05 | three cherries | 1X |
| 6th | No. 01 | two sevens | |
| 7th | No. 03 | two bars | |
| 8th | No. 08 | two lemons | |
| 9th | No. 06 | two cherries | |
| 10th | No. 02 | no matches | |

Display 60 can name the symbols or show the actual symbols. Display 60 can describe card hands, such as "two pairs," "full house," etc. The display of the awards 50×, 10×, 5×, 2× and 1× is the display of one example of a paytable of system 100. This paytable can also be displayed in various places and on certain screens of display devices 16 and 18 of machines 10. The paytable is set for the top five machines in the above example. The paytable or a different table can also show that, for example, four sevens are worth more than four cherries. Three bars are worth more than three lemons, which are worth more than three cherries, etc. In examples shown below, the paytable may vary based on how many gaming devices 10 within system 100 are active. After showing the above table, common display 60 switches and shows the next countdown.

The Gaming System Implemented with Slot Game

In one embodiment system 100 is implemented with slot machines or internet slot play. FIG. 5 illustrates one embodiment of system 100, in which a plurality of (e.g., ten) slot machines 10*a* to 10*j* (referred to collectively as gaming devices 10 or generally as gaming device 10) are each linked via links 58 to a central server 56. Central server 56 also communicates with a large common display 60, which is viewable by each of the players playing in the cluster of machines of system 100.

Reference is also made to FIGS. 2A and 2B, which show that each slot machine 10 (and the internet version of slot) includes one or more paylines 52. Paylines 52 may be horizontal, vertical, circular, diagonal, angled or any combination thereof. Slot machine gaming device 10 displays at least one reel 54, such as three to five reels in either electromechanical form with mechanical rotating reels or in video form with simulated reels and movement. In electromechanical form, stepper motors in an embodiment rotate and stop the reels at the randomly determined positions. In video form, reels 54 are simulated and made to look like they spin and stop through a video and/or animation display on display devices 16 and/or 18.

In addition to credit display 20, bet display 22 and play button 34, display device 16 or 18 of slot machine 10 can also display the number of paylines 52 played as well as the bet made per payline 52. Gaming device 10 also provides input devices 30 that enable the player to change the number of paylines 52 wagered and bet per payline 52, respectively. In one embodiment, slot machine 10 provides input devices 30 that enable the player to wager consecutive paylines 52, e.g., paylines one, two and three out of nine total paylines or wager non-consecutive paylines 52, e.g., paylines one and nine out of nine total paylines. In one embodiment, slot machine 10 provides input devices 30 that enable the player to: (i) wager a same amount on each payline, for example, three credits out of five possible credits on paylines one, two and three out of nine total paylines; or (ii) wager different amounts on different paylines, for example, five credits, two credits and one credit, respectively, on paylines one, two and three (or paylines two, seven and eight) out of nine total paylines.

Figure 6A:
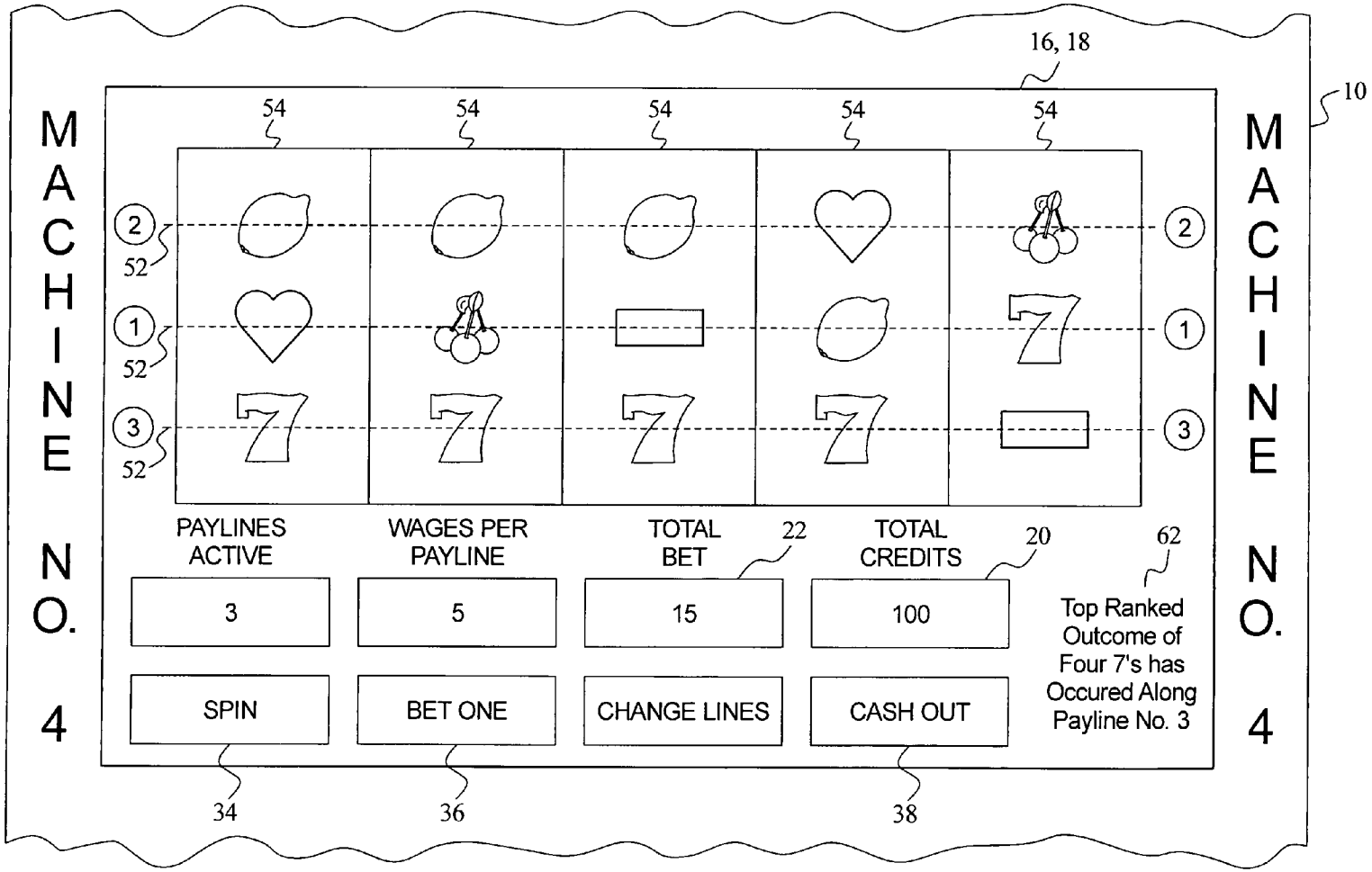
FIGS. 6A and 6B illustrate an example slot game play in one embodiment of the ranked multiplayer gaming system.

As seen in FIG. 6A, each reel 54 of slot machine 10 (e.g., machine 4 of 10 of system 100) displays a plurality of generated symbols, such as bells, hearts, fruits, numbers, letters, bars or other images, which correspond to a theme associated with slot machine 10 in one embodiment. In the illustrated example, payline one has no matches, payline two has three lemons and payline three has four 7's. A local or remote processor determines a best or lowest probability outcome out of the three payline outcomes for slot machine 10 to be the four 7's. Message 62 on display device 16, 18 informs the player visually, audibly, or both that the top-ranked outcome of four 7's has occurred along payline three.

In an alternative embodiment, system 100 compares and ranks the top played payline for each active gaming device 10. Here, for example, if the player plays only paylines one and two, the top played payline one yields three lemons. System 100 uses three lemons from the machine for comparison, even though unplayed payline three has a lower probability outcome of four 7's. This option is available for each of the different types of gaming devices discussed herein.

Figure 6B:
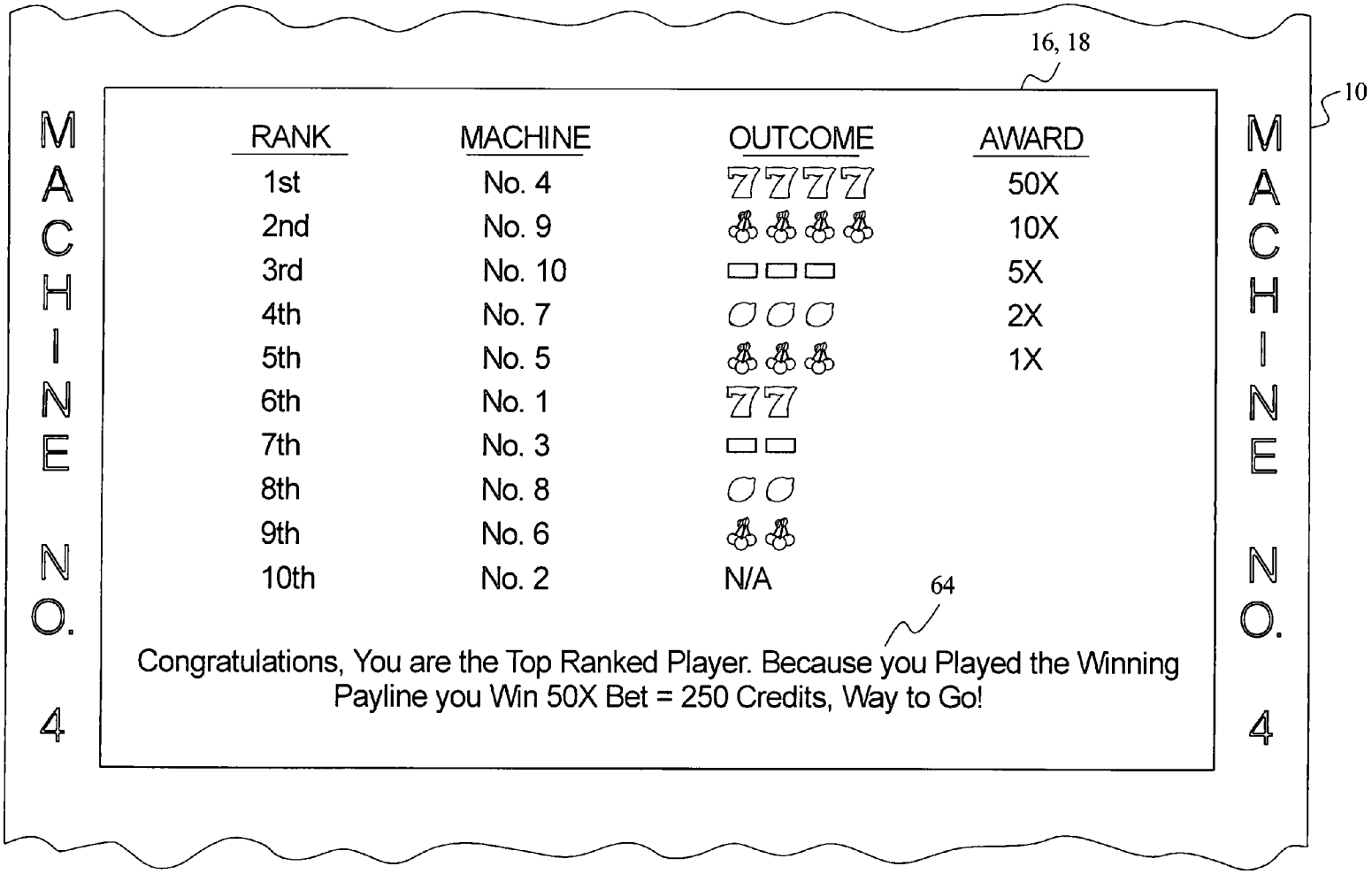

As seen in FIG. 6B, the best outcome of slot machine (4 of 10) is compared with the best outcomes of the other slot machines (1, 2, 3, 5, 6, 7, 8, 9 and 10) of system 100. A limited number of awards (e.g., five) are made available to the slot machines generating the highest ranked outcomes. If the highest ranked outcomes have occurred on an actively played payline 52 of gaming device 10, which is the case in FIG. 6B, the respective player receives the award. In the example illustrated in FIG. 6B, message 64 indicates that the player receives the award result of 50× times the wager per the winning payline of five credits or 250 credits. If the player had not wagered payline no. 3, the message could instead read, "Your top payline ranked the highest. Highest rank pays 50× for an active payline."

In prior art slot games, the player plays in essence against a paytable, e.g., the paytable awards X credits for achieving two cherries on an active payline, Y credits for achieving three bars on an active payline, Z credits for achieving four sevens on an active payline. The payout occurs according to the paytable regardless of what is occurring on other gaming devices. In one embodiment of the present system and method, however, there is no such fixed paytable. Instead, certain awards are made available for a particular ranking, e.g., a 50× for a first place ranking, a 10× for a second place ranking, a 5× for a third place ranking, a 2× for a fourth place ranking and a 1× for a fifth place ranking. Multiplier awards are desirable because they motivate the player to wager more credits per payline 52.

The rankings are based in one embodiment on the likelihood of the outcome. For example, a four cherry outcome would receive a higher ranking than a three cherry outcome because it is more difficult or less likely to achieve four cherries on a payline 52 than to receive three cherries.

In the present system and method, relative ranking, not the actual outcome controls (i) whether or not the player wins an award and (ii) the size of the award. A particular slot machine may not receive a relatively good or low probability outcome but still win an award because the other slot machines have received even lesser or higher probability outcomes. Conversely, a particular slot machine may receive a relatively good or low probability outcome but either not win an award or win a lower ranked award because other slot machines have received better or lower probability outcomes.

Slot machine 10 in one embodiment provides multiple paylines 52. In one embodiment base game outcomes are generated for each payline 52 of each gaming device regardless of whether each payline is wagered or whether the gaming device is being played. The best outcome for each gaming device is submitted to central server 56 for evaluation and ranking. For example, assuming ten slot machines each have nine paylines, ninety outcomes are generated after each countdown regardless of how many paylines are actually being paid. For each gaming device, the best (least likely or lowest percentage) outcome is submitted for ranking. If the paytable above 50×, 10×, 5×, 2× and 1×) is used, awards are made available to five of the ten machines. Here, if the player plays all nine lines, the player receives some payback approximately half the time. In an alternative embodiment, each gaming machine submits more than one payline or outcome for ranking or comparison with the other gaming machine outcomes. In such embodiments, one gaming machine could win a plurality (or all) of awards because that gaming machine achieved a plurality of (or all of) the highest rankings.

As discussed herein, while the above awards are made available to each of the machines after every simultaneous play, the player only receives the award if it has been achieved an active payline 52 in one embodiment. If for example, a player plays paylines one, two and three out of nine paylines and the top ranked outcome out of all ninety outcomes occurs along payline five, the top ranked award, e.g., 50×, is made available to slot machine 10 but is not actually downloaded to credit meter 20 of the slot machine.

Structuring system 100 as described above ensures that the awards are guaranteed regardless of how many players are playing. That is, a single player may play system 100 and wager on only one payline. Here, system 100 only receives one coin per countdown or the player has a 1/90 chance of winning the top award or any other designated award (using the above described example with ten gaming machines each having nine paylines).

The comparison or ranking is made according to a series of rules. If two or more slot machines 10 receive the same ranking (e.g., if the machines 10 submit two or more of the same outcomes or equally weighted results) the system can in alternative embodiments split the award or look to see which of the tied slot machines 10 has an active payline 52. If both machines 10 have an active payline 52, system 100 looks to the outcome of the next best played payline 52 of both slot machines 10. For example, if slot machines A and B both have a ranking based on four active payline cherries, slot machine A has a next best result from an active payline 52 of two cherries and slot machine B has a next best result from an active payline 52 of three cherries, slot machine B wins the ranking and slot machine A receives the next best ranking. If slot machines A and B both have second best active payline 52 results of three cherries, the system compares the third best active payline 52 result and so on until one slot machine 10 has a better outcome (wins) or runs out of played paylines (loses).

Following the above example, if the four cherries occurs on an active payline 52 for slot machine A and a non-active payline 52 for machine B, slot machine A wins in one embodiment. In another embodiment, the next best result on an active payline 52 of slot machine A is compared to the next best result (active or non-active) of slot machine B and so on until one slot machine has a better outcome (wins) or machine A runs out of played paylines (loses).

Following the above example, if the four cherries occurs on a non-active payline 52 for machine A and a non-active slot payline 52 for machine B, the next best result of machine A is compared to the next best result of slot machine B and so on until one slot machine has a better outcome and wins. In a case in which two slot machines 10 have the exact same result, the ranked award and the succeeding award result could be cumulatively split (e.g., 10×+5×=15×/2=7.5×) for two active slot machines 10 or provided to one of the slot machines 10 if it is the only one in which the ranked payline 52 is active.

Bonus Play

In one embodiment, in addition to winning credits in the base or primary game slot game, gaming device 10 also gives players the opportunity to win credits in a bonus or secondary game or bonus or secondary round. The bonus or secondary game enables the player to obtain a bonus prize or payout in addition to the prize or payout, if any, obtained from the base or primary game. A bonus or secondary game can produce a higher level of player excitement than the base or primary game because it can provide a greater expectation of winning than the base or primary game, can be accompanied by attractive and little seen or heard visual and audio outputs, and generally does not require a separate wager to play.

In one embodiment, central server 56 initiates the operation of a bonus game even if individual processors 12 generate results for the bonus game. The bonus game is implemented as a program code stored in memory device 14 or at central server 56, which the appropriate processor processes to automatically begin, e.g., a simultaneously played bonus round when an associated triggering event is achieved.

For slot, the bonus game can be triggered in multitude of ways. In one example, a particular bonus symbol appearing on any payline 52 of each of the slot machines triggers the bonus game. In another example, a particular bonus symbol appearing on any active payline 52 of each of the slot machines 10 triggers the bonus game. In a further example, a particular bonus symbol appearing on the best payline 52 outcome (the outcome that is compared for award generation) of each of the slot machines 10 triggers the bonus game. In another example, a threshold combination, e.g., three symbols, appearing on any payline 52 of each of the slot machines 10 triggers the bonus game. In a further example, a threshold combination, e.g., three symbols, appearing on any active payline 52 of each of the slot machines 10 triggers the bonus game. In a further example, a threshold combination, e.g., three symbols, appearing on the best payline 52 outcome (the outcome that is compared for award generation) of each of the slot machines 10 triggers the bonus game. The foregoing list illustrates that those of skill in the art can devise multiple ways of triggering slot bonus games.

As discussed above, the bonus games are played simultaneously by each of the machines in one embodiment. The bonus may be in the form of a race, in which, for example, gaming devices No. 1 to No. 10 each place in one of ten positions. The bonus pay any machine receives is based on the position in which the machine places. The bonus pool may be paid to a select group of machines 10, as with the base game, or to each of the machines 10. For example, if the bonus pool is two hundred credits, sixty credits may be paid to the 1st place machine, fifty credits may be paid to the 2nd place machine, forty credits may be paid to the 3rd place machine, fifteen credits may be paid to the 4th place machine, twelve credits may be paid to the 5th place machine, eight credits may be paid to the 6th place machine, six credits may be paid to the 7th place machine, four credits may be paid to the 8th place machine, three credits may be paid to the 9th place machine, and two credits may be paid to the 10th place machine. Here, each machine wins at least some award as a result of bonus play.

The bonus pool in one embodiment is built into the overall paytable and payback percentage. For example, the seventy-five percent payback percentage can be increased to, e.g., eighty, eighty-five or ninety percent, to pay for the bonus game. The bonus pool in an embodiment is a progressive pool, such as one of the progressive pools described herein.

In one embodiment, no separate entry fee or buy in for a bonus game is needed. Players may not purchase entry into the bonus game. The players have to win or earn entry through play of the primary game, thereby encouraging play of the primary game. In another embodiment, participation in the bonus game may be contingent upon a particular wager requirement, such as maximum paylines wagered or maximum wager on all paylines.

Bonus Pays

As discussed above, base game play pits one machine 10 against the other machines of system 100, rather than against a set paytable. Nevertheless, system 100 includes bonus pays to gaming devices 10 for achieving particular base game outcomes. For example, in addition to the 50× made available to the top machine, system 100 may provide an additional multiplier for a particularly rare outcome (e.g., five like symbols appearing along any single payline 52). Bonus pays may be made to outcomes that are not top ranked, e.g., five cherries gets bonus pay as second ranked outcome even though five sevens is the first ranked outcome (which would also get a bonus pay). System 100 also pays for the bonus pays out of the payout percentage remaining above the base game payout percentage (e.g., from the twenty-five percent spread).

Progressive Pays

The payout percentage remaining after the base game payout may be applied to form a progressive pool. The progressive pool is a linked progressive in one embodiment as described above. The progressive pool may be triggered, e.g., by achieving the best outcome possible in the base game or via a particular result in a bonus game.

The Gaming System Implemented with Poker

The system 100 may also be implemented with poker machines or with internet poker. In one embodiment gaming device 10 plays a standard game of stud poker, which may or may not include a wild card. For example, gaming device 10 can deal five cards, all face up, from a virtual deck of fifty-two cards, from multiple decks of cards or from some other grouping of playing cards. Like multiple paylines of slot, the player may play multiple hands of poker simultaneously. Here, each hand may be dealt from a single deck or a same group of multiple decks. Or, each hand may be dealt from a different deck or different group of multiple decks.

Game play results in a single hand of cards or multiple hands of cards. If a single hand, the system compares and ranks that hand against the single hands from other poker gaming machines. If multiple hands, the system compares and ranks the best or least likely hand from the multiple hands against the best or least likely hands from other the poker gaming machines of the system.

Figure 7A:
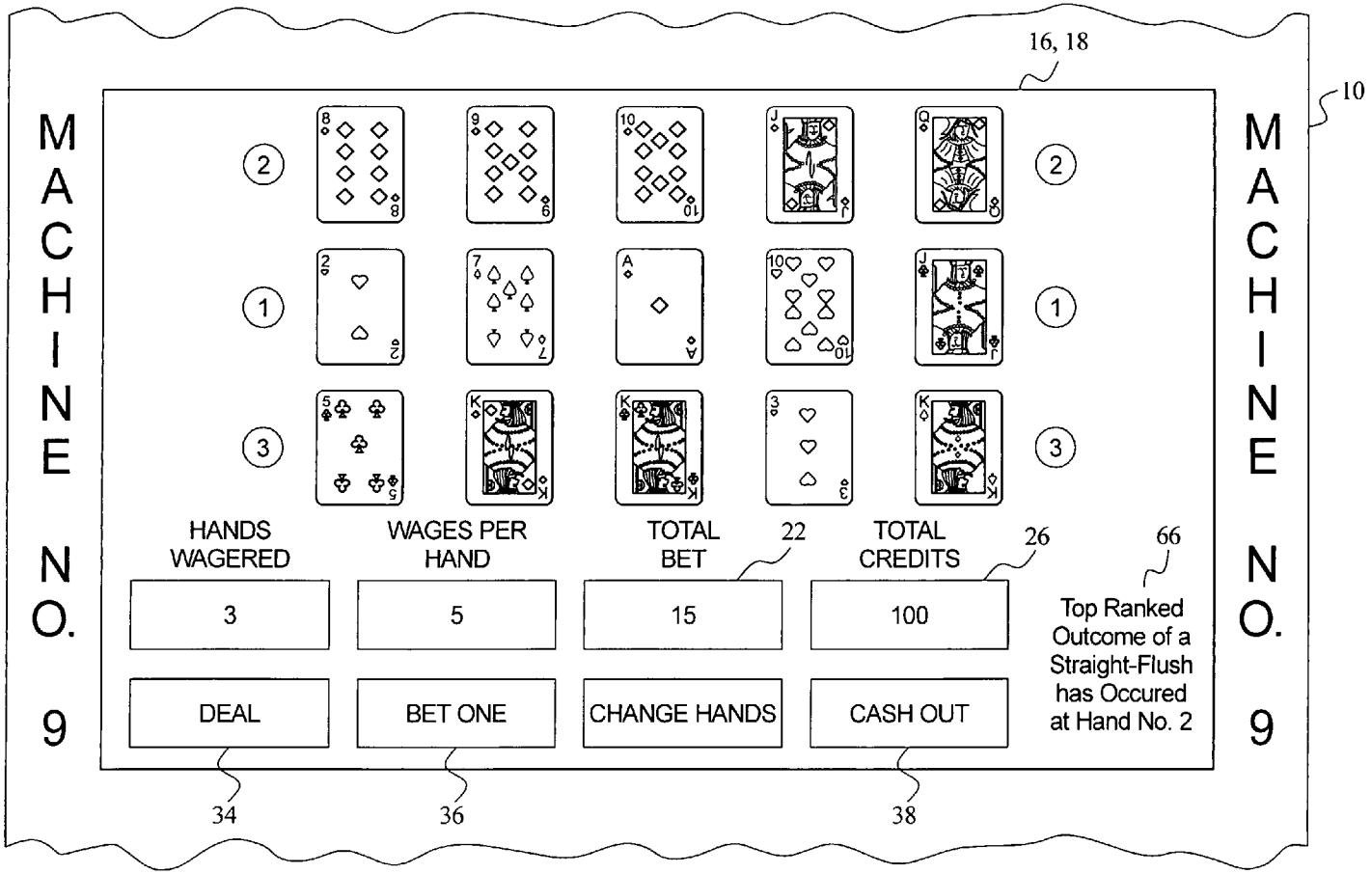
FIGS. 7A and 7B illustrate an example poker game play in one embodiment of the ranked multiplayer gaming system.
Figure 7B:
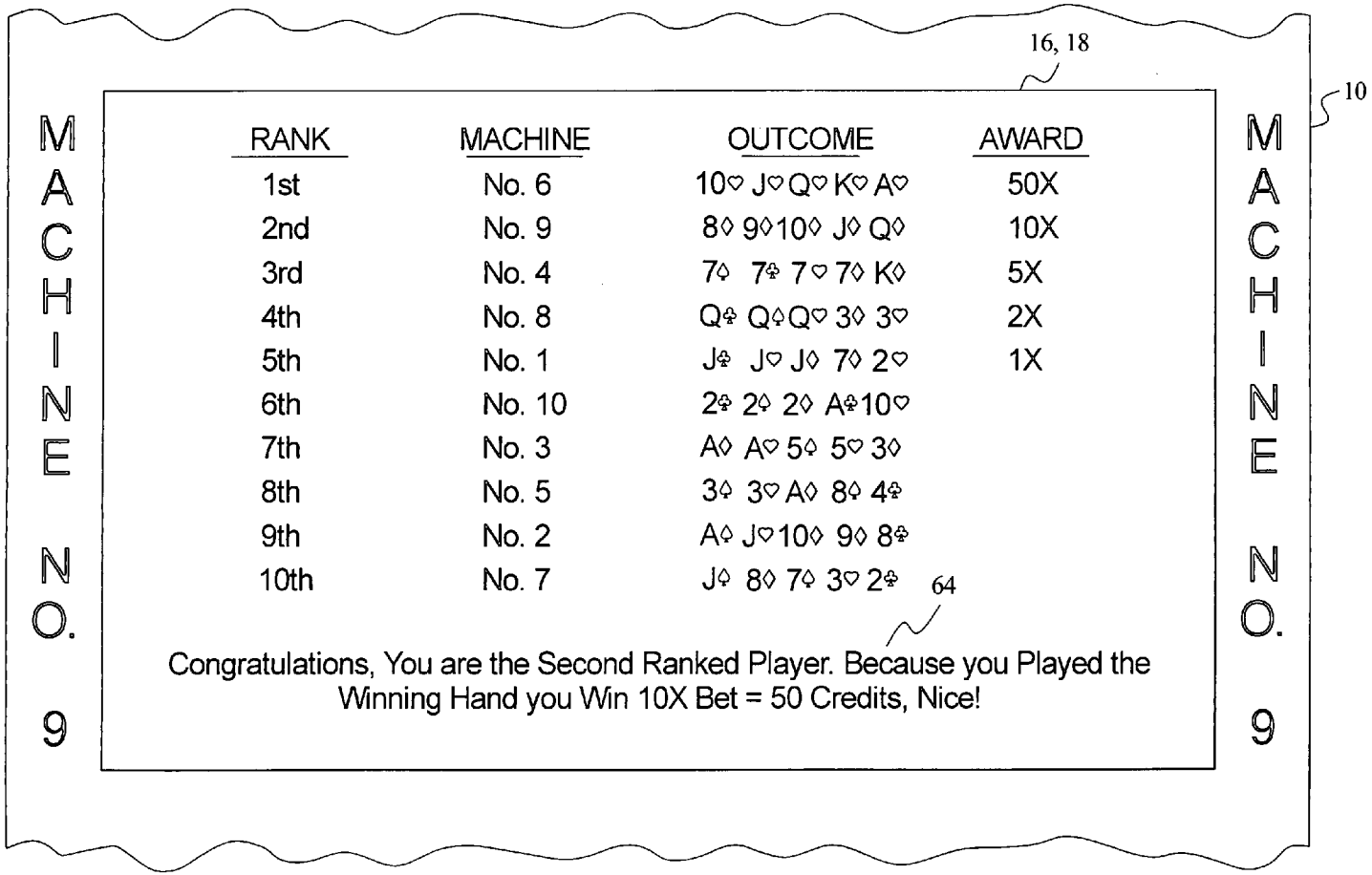

One example of a multiple hand stud poker game is illustrated by FIGS. 7A and 7B. Here, the player wagers all three possible simultaneous hands of poker at once, as seen in FIG. 7A, and obtains outcomes of Ace high, a straight flush and three-of-a-kind, Message 66 indicates that system 100 accordingly uses the straight flush for that poker machine (machine #9) for comparison.

As seen in FIG. 7B, display device 16, 18 of gaming device 10 (machine No. 9) receives the second best hand, which makes that machine eligible for the second highest pay, namely 10×. Message 68 informs the player that an award of 10× times five credits or 50 credits is provided to the player for wagering on hand No. 2.

As with slot, the system with poker makes awards available to a limited number of the machines associated with the top ranked poker hands. The rankings are based in one embodiment on the likelihood of the outcome. For example, four-of-a-kind would receive a higher ranking than a straight because it is more difficult or less likely to achieve four-of-a-kind than a straight.

In another embodiment, the poker game may be a draw poker game. Here, after being dealt an initial hand of, e.g., five cards, the player selects which of those cards to hold by using one or more input device 30, such as an electromechanical or touchscreen hold button. The player then presses a deal button, and processor 12 of poker gaming device 10 removes the unwanted or discarded cards from the display and deals replacement cards from the remaining cards in the deck, resulting in a final five-card hand. In a single hand draw poker game, the system compares and ranks that final five-card hand with the single five-card hands of the other gaming devices linked in the system.

With multiple hand draw poker, the player chooses which cards to hold in a primary hand. The held cards in the primary hand are also held in the other player hands of cards. The non-held cards are removed from each displayed hand and replaced with randomly dealt cards forming multiple final hands. Since the replacement cards are randomly dealt independently for each hand, the replacement cards will usually be different for each hand. The system compares and ranks the best or least likely final hand from the multiple final hands against the best or least likely final hands from other the poker gaming machines of the system.

Base game poker play is synchronized and awards are distributed as described above in connection with FIGS. 1, 2, 3, 4, 5, 6A and 6B. For multiple hand poker, system 100 in one embodiment generates outcomes for each possible hand, regardless of whether or not each has been wagered upon. System 100 ranks the best hand of each gaming device and makes an award available to each of a select number of top-ranked hands. The award is actually provided to any of the select hands that the players have wagered. In an alternative embodiment, system 100 uses the best wagered hand so that the player is guaranteed to win an award if the hand is one of the select number of top-ranked hands. The system can be employed with all bonus game, bonus pay, progressive and other applicable teachings discussed herein for the poker game.

The Gaming System Implemented with Keno

In one embodiment, the system is implemented with keno machines or with internet keno. In keno, the player selects a set of numbers from a larger pool of numbers. Numbers are then drawn randomly from the pool and compared with the player's set of numbers. Gaming device 10 displays the drawn numbers to determine an amount of matches, if any, between the player's selected numbers and the gaming device's drawn numbers.

In normal keno, the player is provided an award, if any, based on the amount of matches between player and gaming device numbers according to a set paytable. In the system, multiple keno machines or internet keno players are linked. The number of matches for each player is compared and ranked. The system provides awards to the machines or players associated with the top ranked numbers of matches.

In an embodiment of the keno system, each player picks the same amount of numbers, e.g., ten from a set pool of numbers, e.g., the numbers one through eighty. If the system links keno machines that are not currently being played, the system can generate, e.g., ten player numbers, which are compared against the system's drawn numbers. Or, the system can make the award determination based on just the machines that are being played currently. For example, the system can be set to provide an award to, e.g., approximately the top twenty-five percent of ranked results. According to this setting, approximately twenty-five active machines would receive an award if one hundred machines are active out of, e.g., two hundred machines in total that are linked to the system. If only eighty of the hundred machines are active, the system provides awards to approximately twenty of the active machines.

The game drawn numbers can be done individually for each machine or be the same for each linked machine 10. In either case, with keno, there is likely going to be multiple gaming machines that generate the same outcome. System 100 employs one possible solution is as follows. First, a nominal payback ratio is chosen such as eighty percent. That is, if one hundred players each wager one coin, an eighty percent payback ratio would yield an eighty coin purse. If out of the 100 players, 4 players obtain seven matches, 8 players obtain six matches, 12 players obtain five matches, 18 players obtain four matches, 20 players obtain three matches, 17 players obtain two matches, 13 players obtain one match and 8 players obtain no matches, then the awards can be determined as follows. First, the players in the match groups are counted beginning with the top groups until the total comes as close as possible to a set amount of winners, for example, one quarter of games played or twenty-five in this example. That is, the system is set to payback to one quarter of the played machines or as close as possible. Here, 4 (seven matches)+8 (six matches)+12 (five matches) totals 24, while 4+8+12+18 (four matches) totals 42. Accordingly, the system will pay back to the top 24 (closer to 25 than is 42) machines, here, any machine obtaining at least five matches.

A suitable pay scale can also be employed. In various examples, the pay scale can be set so that the player having six matches wins twice as much as the player having five matches; or the player having seven matches may win twice as much as the player having six matches.

It should be appreciated that the same results above would be achieved if the top twenty-four players broke down as 12 six match players, 8 seven match players and 4 eight match players; or 12 three match players, 8 four match players and 4 five match players. The payback ratios above leave room for bonus payouts, e.g., to any player(s) achieving nine or ten matches. To that end, a progressive pool may be built (e.g., from two credits taken out of every one hundred credits wagered), wherein the progressive pool is paid out whenever, for example, ten matches is hit.

The progressive pool is paid out in a bonus game in one embodiment. The bonus trigger could be any suitable trigger, such as the system 100 drawing one or more randomly or predetermined bonus numbers from the pool of numbers one to eighty. The bonus game could also be triggered if each of or a certain percentage of machines achieves a threshold number of matches, e.g., each machine achieves at least one match. The bonus could be played and paid out in the same manner as described above, however, the available credits could be much higher than in base game play. That is, if two credits are paid into the pool for every one hundred wagered and the bonus is played once in every 50,000 wagers on average (e.g., every 500 plays assuming one hundred wagers per play), 1000 credits would be paid out on average from the bonus game.

Each of the teachings associated with FIGS. 1, 2, 3, 4, 5, 6A, 6B, 7A and 7B and all bonus game, bonus pay and progressive and other applicable teachings discussed herein can be implemented with the game of keno.

The Gaming System Implemented with Roulette

The known game of roulette can include a wheel with thirty-seven or thirty-eight 38 stops and a ball that can land with equal chance in any of those stops. Players wager by marking betting areas of a corresponding roulette table. After all bets are placed, a ball is spun and lands randomly on a number. Wagers placed on the winning number or on groups that include the winning number are paid a multiple of the bet. The house collects all other wagers. A sample pay scale for roulette is as follows: (i) even, odd, red, black pay 1:1; (ii) Groups of numbers 1 to 12, 13 to 24, 25 to 36 and columns of numbers on table pay 2:1; (iii) any single number pays 35:1; and (iv) any two number combination pays 17:1.

The roulette system 100 may be employed in a plurality of ways. In one embodiment, a separate, e.g., a simulated or electromechanical, roulette wheel is spun for each gaming device 10 of system 100. Here, the outcomes can be ranked based on a particular set point, e.g., highest number or lowest number. In this implementation, depending upon how many gaming devices 10 are part of system 100, multiple outcomes are likely to be the same. Any of the tie breaking procedures discussed above for keno may be employed here.

In another embodiment, the same roulette wheel is spun for each gaming device 10 of system 100. Here, for example, the player picks a number and the player's rank is based on how close the roulette spin outcome is to the player's pick. Here again, any of the above-described tie breaking procedures discussed above for keno may be employed here.

The teachings associated with FIGS. 1, 2, 3, 4, 5, 6A, 6B, 7A and 7B and any bonus game, bonus pay, progressive and other applicable teachings discussed herein may be implemented with the game of roulette.

Combination Gaming Devices

Referring now to FIG. 8, a chart shows a schematic set of winning symbol combinations for slot and poker. The combinations match one to one in terms of number and probability. System 100 includes combination gaming devices, such as poker and slot, wherein such winning symbol combinations (or like set of combinations) is employed with gaming devices having the same number of wagerable options, for example, the same number of wagerable paylines or hands.

In the combination embodiment it does not matter which type of game the player plays. System 100 generates outcomes for each of the paylines and hands, for example, as has been described herein. Each gaming device produces a best outcome (e.g., best kind or payline), which is compared and ranked with the best outcomes from each other machine of the system. In FIG. 8, five 7's beats a straight flush. A royal flush beats five bars. Five bars beats four-of-a-kind, and so on.

The combination gaming system employs any of the rule breaking procedures discussed herein, including looking to the next best active versus non-active payline and had outcomes. As before the player is paid only for active paylines or hand wins. Alternatively, the players best played outcome is submitted to system 100 for comparison and ranking. The teachings associated with FIGS. 1, 2, 3, 4, 5, 5A, 6B, 7A and 7B and any bonus game, bonus pay, progressive pay and any other applicable teachings discussed herein may also be implemented with the combination gaming system 100.

It should also be appreciated that a scaled paytable may be employed which depends on the number of gaming machines in the system being played. In one such embodiment, the larger the number of players in the system the better the paytable.

It should further be appreciated that in one embodiment, if all machines have been "played" (e.g., a wager has been made and the play button has been pressed), the next set of games can begin automatically. In one embodiment, the play begins if all gaming machines on which credits are held have been played.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

a plurality of gaming devices, each gaming device including:

a housing;

a display device supported by the housing;

a plurality of input devices supported by the housing, the plurality of input devices including an acceptor;

a first processor; and a memory device which stores a plurality of instructions, which when executed by the first processor, cause the first processor to operate with the display device and the plurality of input devices to:

(a) establish a credit balance for a player based at least in part on a monetary value associated with a physical item responsive to receipt of the physical item by the acceptor, wherein the physical item is one of: (1) a ticket associated with the monetary value, and (2) currency;

(b) place at least one wager on a play of a game responsive to an actuation of a wager button, the at least one wager deducted from the credit balance;

(c) randomly generate and display at least one of a plurality of different individual outcomes for said play of the game, wherein each generated individual outcome is one of: (a) associated with the at least one wager, and (b) not associated with the at least one wager;

(d) display any primary awards associated with the play of the game, the credit balance increased by any primary awards; and (e) initiate a payout associated with the credit balance responsive to an actuation of a cashout button; and a second processor programmed to:

(i) for each of the gaming devices, obtain the at least one individual outcome generated for the play of the game of said gaming device provided upon the at least one wager regardless of whether said at least one individual outcome is associated with the at least one wager;

(ii) compare and rank each obtained individual outcome;

(iii) designate an award for the gaming device from which a highest ranked individual outcome was obtained;

(iv) if the highest ranked individual outcome is associated with one of the wagers, cause said gaming device to provide said award; and (v) if the highest ranked individual outcome is not associated with one of the wagers, do not cause said gaming device to provide said award.

2. The gaming system of claim 1, wherein a probability of occurrence of the highest ranked individual outcome is less than probabilities of occurrence of the other compared individual outcomes.

3. The gaming system of claim 1, wherein the game is one selected from the group consisting of: slot, poker, keno, and roulette.

4. The gaming system of claim 1, wherein the second processor has at least one characteristic selected from the group consisting of:

(i) being in one of the gaming devices;

(ii) being separate from and in communication with the gaming devices; and (iii) being provided with a central determination server, the central determination server configured to generate the individual outcomes from the plays of the game for the gaming devices.

5. The gaming system of claim 1, wherein the award is one selected from the group consisting of: a designated award, a bonus game and a progressive award.

6. The gaming system of claim 1, wherein the second processor is programmed to:

(i) designate a second award for the gaming device from which a second highest ranked individual outcome was obtained, said award being greater than the second award, (ii) if said second highest ranked individual outcome is associated with one of the wagers, cause said gaming device to provide said second award, and (iii) if said second highest ranked individual outcome is not associated with one of the wagers, do not cause said gaming device to provide said second award.

7. The gaming system of claim 6, wherein the second processor is programmed to:

(i) designate a third award for the gaming device from which a third highest ranked individual outcome was obtained, said second award being greater than the third award, (ii) if said third highest ranked individual outcome is associated with one of the wagers, cause said gaming device to provide said third award, and (iii) if said third highest ranked individual outcome is not associated with one of the wagers, do not cause said gaming device to provide said third award.

8. The gaming system of claim 1, wherein the plays of the game from which the individual outcomes are obtained for comparison are synchronized.

9. The gaming system of claim 8, wherein the gaming devices each include an opt-in input device which enables the player of said gaming device to wager on a next synchronized play of the game on said gaming device.

10. The gaming system of claim 1, wherein for each gaming device, when executed by the first processor, the plurality of instructions cause the first processor to operate with the display device and the plurality of input devices to enable the player to place multiple wagers on the play of the game on said gaming device, and wherein the individual outcomes compared by the second processor are best outcomes respectively from each of the plays of the game of the gaming devices.

11. The gaming system of claim 1, wherein at least a portion of the award is placed in a progressive pool when said award is not provided.

12. The gaming system of claim 1, wherein for each gaming device, when executed by the first processor, the plurality of instructions cause the first processor to operate with the display device to display at least one of:

(i) a countdown to a next play of the game of said gaming device;

(ii) a ranking of the individual outcomes from each of the gaming devices for the play of the game; and (iii) which of the gaming devices has the highest ranked individual outcome.

13. The gaming system of claim 1, which includes a display device common to a plurality of the gaming devices, the display device configured to display at least one of:

(i) a countdown to a next play of the game for each gaming device;

(ii) the compared individual outcomes from the plays of the game;

(iii) a ranking of the compared individual outcomes from the plays of the game; and (iv) which of the gaming devices has the highest ranked individual outcome.

14. A gaming system comprising:

a plurality of gaming devices, each gaming device including:

a housing;

a display device supported by the housing;

a plurality of input devices supported by the housing, the plurality of input devices including an acceptor;

a first processor; and a memory device which stores a plurality of instructions, which when executed by the first processor, cause the first processor to operate with the display device and the plurality of input devices to:

(a) establish a credit balance for a player based at least in part on a monetary value associated with a physical item responsive to receipt of the physical item by the acceptor, wherein the physical item is one of: (1) a ticket associated with the monetary value, and (2) currency;

(b) place at least one wager on a play of a game responsive to an actuation of a wager button, the at least one wager deducted from the credit balance;

(c) randomly generate and display at least one of a plurality of individual outcomes for said play of the game, wherein each generated individual outcome is one of: (a) associated with the at least one wager, and (b) not associated with the at least one wager;

(d) display any primary awards associated with the play of the game, the credit balance increased by any primary awards; and (e) initiate a payout associated with the credit balance responsive to an actuation of a cashout button; and a second processor programmed to:

(i) for each of the gaming devices, obtain the at least one individual outcome generated for the play of the game of said gaming device provided upon at least one wager regardless of whether said at least one individual outcome is associated with the at least one wager;

(ii) compare and rank each said obtained individual outcome;

(iii) designate a plurality of awards for a plurality of the highest ranked individual outcomes; and (iv) for each of the highest ranked individual outcomes:

(1) if said individual outcome is associated with one of the wagers, cause the gaming device from which said individual outcome was obtained to provide the award designated for said individual outcome, and (2) if said individual outcome is not associated with one of the wagers, do not cause said gaming device to provide said award.

15. The gaming system of claim 14, wherein the game is one selected from the group consisting of: slot, poker, keno, and roulette.

16. The gaming system of claim 14, wherein the second processor has at least one characteristic selected from the group consisting of:

(i) being in one of the gaming devices;

(ii) being separate from and in communication with the gaming devices; and (iii) being provided with a central determination server, the central determination server configured to generate the individual outcomes from the plays of the game for the gaming devices.

17. The gaming system of claim 14, wherein each award is one selected from the group consisting of: a designated award, a bonus game and a progressive award.

18. The gaming system of claim 14, wherein the plays of the game from which the individual outcomes are obtained for comparison are synchronized.

19. The gaming system of claim 18, wherein the gaming devices each include an opt-in input device which enables the player of said gaming device to wager on a next synchronized play of the game on said gaming device.

20. The gaming system of claim 14, wherein for each gaming device, when executed by the first processor, the plurality of instructions cause the first processor to operate with the display device and the plurality of input devices to enable the player to place multiple wagers on the play of the game on said gaming device, and wherein the individual outcomes compared by the second processor are best outcomes respectively from each of the multiple plays of the game of the gaming devices.

21. The gaming system of claim 14, wherein at least a portion of each award is placed in a progressive pool when said award is not provided.

22. The gaming system of claim 14, wherein for each gaming device, when executed by first processor, the plurality of instructions cause the first processor to operate with the display device to display at least one of:

(i) a countdown to a next play of the game of said gaming device;

(ii) a ranking of the individual outcomes from each of the gaming devices for the play of the game; and (iii) which of the gaming devices has the highest ranked individual outcomes.

23. The gaming system of claim 14, which includes a display device common to a plurality of the gaming devices, the display device configured to display at least one of:

(i) a countdown to a next play of the game for each gaming device;

(ii) the compared individual outcomes from the plays of the game;

(iii) a ranking of the compared individual outcomes from the plays of the game; and (iv) which of the gaming devices has the highest ranked individual outcomes.

24. The gaming system of claim 14, wherein the second processor is programmed to: designate at least one award for at least two gaming devices having the same ranked individual outcomes.

25. A gaming system comprising:

a plurality of gaming devices, each gaming device including:

a housing;

a display device supported by the housing;

a plurality of input devices supported by the housing, the plurality of input devices including an acceptor;

a first processor; and a memory device which stores a plurality of instructions, which when executed by the first processor, cause the first processor to operate with the display device and the plurality of input devices to:

(a) establish a credit balance for a player based at least in part on a monetary value associated with a physical item responsive to receipt of the physical item by the acceptor, wherein the physical item is one of: (1) a ticket associated with the monetary value, and (2) currency;

(b) place at least one wager on a play of a game responsive to an actuation of a wager button, the at least one wager deducted from the credit balance;

(c) randomly generate and display two or more of a plurality of individual outcomes for said play of the game, wherein each generated individual outcome is one of: (a) associated with the at least one wager, and (b) not associated with the at least one wager;

(d) display any primary awards associated with the play of the game, the credit balance increased by any primary awards; and (e) initiate a payout associated with the credit balance responsive to an actuation of a cashout button; and a second processor programmed to:

(i) for each of the gaming devices, obtain the two or more individual outcomes generated for the play of the game of said gaming device provided upon the at least one wager regardless of whether said two or more individual outcomes are associated with the at least one wager;

(ii) compare and rank each obtained individual outcome;

(iii) designate an award for the gaming device from which a highest ranked individual outcome was obtained;

(iv) if the highest ranked individual outcome is associated with one of the wagers, cause said gaming device to provide said award; and (v) if the highest ranked individual outcome is not associated with one of the wagers, do not cause said gaming device to provide said award.

26. The gaming system of claim 25, wherein a probability of occurrence of the highest ranked individual outcome is less than probabilities of occurrence of the other compared individual outcomes.

27. The gaming system of claim 25, wherein the game is selected from the group consisting of: slot, poker, keno, and roulette.

28. The gaming system of claim 25, wherein the second processor has at least one characteristic selected from the group consisting of:

(i) being in one of the gaming devices;

(ii) being separate from and in communication with the gaming devices; and (iii) being provided with a central determination server, the central determination server configured to generate the individual outcomes from the plays of the game for the gaming devices.

29. The gaming system of claim 25, wherein the award is one selected from the group consisting of: a designated award, a bonus game and a progressive award.

30. The gaming system of claim 25, wherein the plays of the game from which the individual outcomes are obtained for comparison are synchronized.

31. The gaming system of claim 30, wherein the gaming devices each include an opt-in input device which enables the player of said gaming device to wager on a next synchronized play of the game on said gaming device.

32. The gaming system of claim 25, wherein at least a portion of the award is placed in a progressive pool when the award is not provided.

33. The gaming system of claim 25, wherein for each gaming device, when executed by the first processor, the plurality of instructions cause the first processor to operate with the display device to display at least one of:

(i) a countdown to a next play of the game of said gaming device;

(ii) a ranking of the individual outcomes from each of the gaming devices for the play of the game; and (iii) which of the gaming devices has the highest ranked individual outcome.

34. The gaming system of claim 25, which includes a display device common to a plurality of the gaming devices, the display device configured to display at least one of:

(i) a countdown to a next play of the game for each gaming device;

(ii) the compared individual outcomes from the plays of the game;

(iii) a ranking of the compared individual outcomes from the plays of the game; and (iv) which of the gaming devices has the highest ranked individual outcome.

35. A gaming system comprising:

a plurality of gaming devices, each gaming device including:

a housing;

a display device supported by the housing;

a plurality of input devices supported by the housing, the plurality of input devices including an acceptor;

a first processor; and at least one memory device which stores a plurality of instructions, which when executed by the first processor, cause the first processor to operate with the display device and the plurality of input devices to:

(a) establish a credit balance for a player based at least in part on a monetary value associated with a physical item responsive to receipt of the physical item by the acceptor, wherein the physical item is one of: (1) a ticket associated with the monetary value, and (2) currency;

(b) place at least one wager on a play of a game responsive to an actuation of a wager button, the at least one wager deducted from the credit balance;

(c) randomly generate and display two or more of a plurality of individual outcomes for said play of the game, wherein each generated individual outcome is one of: (a) associated with the at least one wager, and (b) not associated with the at least one wager;

(d) display any primary awards associated with the play of the game, the credit balance increased by any primary awards; and (e) initiate a payout associated with the credit balance responsive to an actuation of a cashout button; and a second processor programmed to:

(i) for each of the gaming devices, obtain the two or more individual outcomes generated for the play of the game of said gaming device provided upon the at least one wager regardless of whether said individual outcomes are associated with the at least one wager;

(ii) compare and rank each obtained individual outcome;

(iii) designate a plurality of awards for a plurality of highest ranked individual outcomes; and (iv) for each of the highest ranked individual outcomes:

(1) if said individual outcome is associated with one of the wagers, cause the gaming device from which said individual outcome was obtained to provide the award designated for said individual outcome, and (2) if said individual outcome is not associated with one of the wagers, do not cause said gaming device to provide said award.

36. The gaming system of claim 35, wherein the game is selected from the group consisting of: slot, poker, keno, and roulette.

37. The gaming system of claim 35, wherein the second processor has at least one characteristic selected from the group consisting of:

(i) being in one of the gaming devices;

(ii) being separate from and in communication with the gaming devices; and (iii) being provided with a central determination server, the central determination server configured to generate the individual outcomes from the plays of the game for the gaming devices.

38. The gaming system of claim 35, wherein each award is one selected from the group consisting of: a designated award, a bonus game and a progressive award.

39. The gaming system of claim 35, wherein the plays of the game from which the individual outcomes are obtained for comparison are synchronized.

40. The gaming system of claim 35, wherein the gaming devices each include an opt-in input device which enables the player of said gaming device to wager on a next synchronized play of the game on said gaming device.

41. The gaming system of claim 35, wherein at least a portion of each award is placed in a progressive pool when the award is not provided.

42. The gaming system of claim 35, wherein for each gaming device, when executed by the first processor, the plurality of instructions cause the first processor to operate with the display device to display at least one of:

(i) a countdown to a next play of the game of said gaming device;

(ii) a ranking of the individual outcomes from each of the gaming devices for the play of the game; and (iii) which of the gaming devices has the highest ranked individual outcomes.

43. The gaming system of claim 35, which includes a display device common to a plurality of the gaming devices, the display device configured to display at least one of:

(i) a countdown to a next play of the game for each gaming device;

(ii) the compared individual outcomes from the plays of the game;

(iii) a ranking of the compared individual outcomes from the plays of the game; and (iv) which of the gaming devices has the highest ranked individual outcomes.

44. A gaming system comprising:

a first gaming machine including:

a first housing;

a first display device supported by the first housing;

a first plurality of input devices supported by the first housing, the first plurality of input devices including a first acceptor;

a first processor; and a first memory device which stores a plurality of instructions, which when executed by the first processor, cause the first processor to operate with the first display device and the first plurality of input devices to:

(a) establish a first credit balance for a first player based at least in part on a first monetary value associated with a first physical item responsive to receipt of the first physical item by the first acceptor, wherein the first physical item is one of: (1) a ticket associated with the monetary value, and (2) currency;

(b) provide a play of a first game upon at least one first wager responsive to an actuation of a first wager button, the at least one first wager deducted from the first credit balance;

(c) randomly generate and display at least one first outcome of a plurality of different first outcomes for the play of the first game, wherein each generated first outcome is one of: (a) associated with the at least one first wager, and (b) not associated with the at least one first wager;

(d) display any first primary awards associated with the play of the first game, the first credit balance increased by any first primary awards; and (e) initiate a first payout associated with the first credit balance responsive to an actuation of a first cashout button;

a second gaming machine including:

a second housing;

a second display device supported by the second housing;

a second plurality of input devices supported by the second housing, the second plurality of input devices including a second acceptor;

a second processor; and a second memory device which stores a plurality of instructions, which when executed by the second processor, cause the second processor to operate with the second display device and the second plurality of input devices to:

(a) establish a second credit balance for a second player based at least in part on a second monetary value associated with a second physical item responsive to receipt of the second physical item by the acceptor, wherein the physical item is one of: (1) a ticket associated with the monetary value, and (2) currency;

(b) provide a play of a second game upon at least one second wager responsive to an actuation of a second wager button, the at least one second wager deducted from the second credit balance;

(c) randomly generate and display at least one second outcome of a plurality of different second outcomes for the play of the second game, wherein each generated second outcome is one of: (a) associated with the at least one second wager, and (b) not associated with the at least one second wager;

(d) display any second primary awards associated with the play of the second game, the second credit balance increased by any second primary awards; and (e) initiate a second payout associated with the second credit balance responsive to an actuation of a second cashout button; and a third gaming machine including:

a third housing;

a third display device supported by the third housing;

a third plurality of input devices supported by the third housing, the third plurality of input devices including a third acceptor;

a third processor; and a third memory device which stores a plurality of instructions, which when executed by the third processor, cause the third processor to operate with the third display device and the third plurality of input devices to:

(a) establish a third credit balance for a third player based at least in part on a third monetary value associated with a third physical item;

(b) provide a play of a third game upon at least one third wager responsive to an actuation of a third wager button, the at least one third wager deducted from the third credit balance;

(c) randomly generate and display at least one third outcome of a plurality of different third outcomes for the play of the third game, wherein each generated third outcome is one of: (a) associated with the at least one third wager, and (b) not associated with the at least one third wager;

(d) display any third primary awards associated with the play of the third game, the third credit balance increased by any third primary awards; and (e) initiate a third payout associated with the third credit balance responsive to an actuation of a third cashout button; and a second processor programmed to:

(i) rank the at least one first, the at least one second and the at least one third outcomes, and (ii) designate an award for at least the gaming machine associated with a top ranked outcome, (iii) cause said gaming machine to provide said award when the top ranked outcome was wagered on, and (iv) do not cause said gaming machine to provide said award when the top ranked outcome was not wagered on.

45. The gaming system of claim 44, wherein the at least one first, the at least one second and the at least one third outcomes have at least one characteristic selected from the group consisting of:

(i) being generated at least substantially simultaneously;

(ii) being slot machine outcomes;

(iii) being poker outcomes;

(iv) being keno outcomes;

(v) being roulette outcomes;

(vi) being base game outcomes;

(viii) being bonus game outcomes;

(ix) being outcomes from different wagering games;

(x) being determined centrally;

(xi) being determined locally;

(xii) being delivered over an internet;

(xiii) being delivered over a wide area network;

(xiv) being delivered over a local area network;

(xv) being completely random outcomes; and (xvi) being a combination of a random determination and a player decision.

* * * * *